US005787961A

United States Patent [19]

Nakamura et al.

[11] Patent Number: 5,787,961

[45] Date of Patent: Aug. 4, 1998

[54] THIXOCASTING PROCESS, FOR A THIXOCASTING ALLOY MATERIAL

[75] Inventors: Takeyoshi Nakamura; Nobuhiro Saito; Kazuo Kikawa; Takeshi Sugawara, all of Saitama, Japan

[73] Assignee: Honda Giken Kogyo Kabushiki Kaisha, Tokyo, Japan

[21] Appl. No.: 543,196

[22] Filed: Oct. 13, 1995

[30] Foreign Application Priority Data

| | | | |
|---|---|---|---|
| Oct. 14, 1994 | [JP] | Japan | 6-275605 |
| Dec. 16, 1994 | [JP] | Japan | 6-334148 |
| Dec. 16, 1994 | [JP] | Japan | 6-334149 |
| Sep. 18, 1995 | [JP] | Japan | 7-263468 |

[51] Int. Cl.[6] ..... B22D 17/00; B22D 23/00

[52] U.S. Cl. ..... 164/113; 164/900; 164/120

[58] Field of Search ..... 164/120, 900, 164/113

[56] References Cited

U.S. PATENT DOCUMENTS

| | | | |
|---|---|---|---|
| 4,726,414 | 2/1988 | Merrien | 164/119 |
| 4,844,146 | 7/1989 | Kikuchi | 164/154 |
| 4,846,252 | 7/1989 | Sato et al. | 164/120 |
| 4,889,177 | 12/1989 | Charbonnier et al. | 164/97 |
| 5,392,842 | 2/1995 | Volpe | 164/284 |
| 5,394,931 | 3/1995 | Shiina et al. | 164/113 |
| 5,531,261 | 7/1996 | Yoshida et al. | 164/900 |

FOREIGN PATENT DOCUMENTS

| | | |
|---|---|---|
| 0099104 | 1/1984 | European Pat. Off. . |
| 3828739 | 3/1989 | Germany . |
| 3828741 | 3/1989 | Germany . |
| 1002546 | 8/1965 | United Kingdom . |
| 1203641 | 8/1970 | United Kingdom . |
| 1203642 | 8/1970 | United Kingdom . |
| 1316852 | 5/1973 | United Kingdom . |
| 2209016 | 4/1989 | United Kingdom . |

OTHER PUBLICATIONS

Excerpt from GeiBerei–Praxis, Dipl.–Ing. Ernst Brunhuber, Fachverlag Schiele & Schon, GmbH, Berlin, "Vergieben teilweise erstarrter Matalle"(1974).

Giesserei 77, 1990, No. 19 – 17th Sep., Hans–Peter Erz, Frankfurt, "Thixocasting—a casting process for near–net–shape production" (1990).

Excerpt from Aluminium, No. 71, 1995, 4 Chr. Ditzler, Singen "Thixoforming—Aluminiumbauteile mit hoher Beanspruchbarkeit und komplexer Gestalt, Teil I".

Excerpt from Giesserei 81 (1994) No. 11, 6th Jun. H. Kaufmann, Ranshofen, "Endabmessungsnahes GieBen: Ein Vergleich von Squeeze–casting und Thixocasting".

(List continued on next page.)

*Primary Examiner*—Scott A. Smith
*Assistant Examiner*—L-H. Lin
*Attorney, Agent, or Firm*—Lyon & Lyon LLP

[57] ABSTRACT

In carrying out of a thixocasting process, a material in a semi-molten state is produced by heating an aluminum alloy material which has a thermal characteristic that a first angled endothermic section generated by the melting of a eutectic crystal and a second angled endothermic section generated by the melting of a component having a melting point higher than a eutectic point exist in a differential calorimetric curve. A start point of a primary pressing stage is established at a point when the temperature T of the material is in a range of $T_1<T\leqq T_4$ in the relationship between the temperature $T_1$ of a rise-start point in the first angled endothermic section and the temperature $T_4$ of a peak of the second angled endothermic section. At the primary pressing stage, the charging of the material into the cavity in a casting mold is completed. A start point of a secondary pressing stage is established at a point when the temperature T of the material is in a range of $T_1<T\leqq T_3$ in the relationship between the temperature $T_1$ of the rise-start point in the first angled endothermic section and the temperature $T_3$ of a drop-end point in the first angled endothermic section. At the secondary pressing stage, the material is solidified.

3 Claims, 35 Drawing Sheets

OTHER PUBLICATIONS

Article, "VergieBen teilweise erstarrter Metalle" (Oct. 1974).

Article, "Thixocasting—ein Giebverfahren zur Near–net–shape–Produktion" (Sep. 1970).

Article, "Thixoforming—Aluminiumbauteile mit hoher Beanspruchbarkeit und Komplexer Gestalt, Teil I" (1995).

Article, "Endabmessungsnahes GieBen: Ein Vergleich Von Squeeze–casting und Thioxcasting" (1994).

100μm

100μm

Al alloy cast product $A_1$

100μm

Al alloy cast product $A_2$

100μm

Al alloy cast product $A_3$

100μm

Al alloy cast product a

100μm

Al alloy cast product $a_2$

Al alloy cast product $a_3$

100μm

100μm

THIXOCASTING PROCESS, FOR A THIXOCASTING ALLOY MATERIAL

BACKGROUND OF THE INVENTION

1. Field of the Invention

The present invention relates to a thixocasting process and particularly, to an improvement in a thixocasting process including the steps of: subjecting to a heating treatment, an alloy material having a differential calorimetric curve in which a first angled endothermic section generated by the melting of a eutectic crystal and a second angled endothermic section generated by the melting of a component having a melting point higher than a eutectic point exist, thereby producing a semi-molten alloy material having a solid phase (which means, throughout the present specification, a substantially solid phase) and a liquid phase coexisting therein, and pressing the semi-molten alloy material to conduct the charging of the semi-molten alloy material into a cavity in a casting mold and the subsequent solidification of the semi-molten alloy material under pressure.

2. Description of the Prior Art

In the prior art, the pressure applied to the semi-molten alloy material is set such that it is rapidly and rectilinearly raised to a predetermined value after charging of the material into the cavity in the casting mold. The reason why the pressure is applied in such manner is that the liquid phase is supplied to portions of the material around the solid phase to prevent the generation of shrinkage cavities.

In this case, a portion around the outer periphery of the solid phase in the semi-molten alloy material filled in the cavity in the casting mold is in a gelled state, and such gelled layer obstructs the flow property of the liquid phase. In order to overcome such obstruction to permit the liquid phase to flow, the pressure is set at a very high value, e.g., in a range of 850 to 2,000 kg f/cm$^2$ in the terms of a plunger pressure.

However, to set the plunger pressure at such a high value as described above, large-sized equipment is required, resulting in a problem that an increase in equipment cost and in turn, an increase in production cost of the cast product, is brought about.

As a high-toughness alloy material, e.g., as a high-toughness aluminum alloy material, AA specification 6000-series alloys are known.

However, when the known 6000-series alloy is used in the thixocasting process, the following problem is encountered: defects such as voids of micron order are liable to be generated at a grain boundary in a cast product, and the fatigue strength of the cast product is low. Such defects are generated due to the fact that supplying of the liquid phase to portions around the solid phase is not conducted in response to the solidification and shrinkage of the solid phase, because the liquid phase produced due to the melting of a eutectic crystal hardly exists in the 6000-series alloy material in a semi-molten state.

Further, for example, an AA specification 238 alloy material containing copper (Cu) with a content of 9.5% by weight $\leqq$Cu$\leqq$10.5% by weight and silicon (Si) with a content of 3.5% by weight $\leqq$Si$\leqq$4.5% by weight is known as a thixocasting Al—Cu—Si based alloy material.

However, when the known 238 alloy material is used in the thixocasting process, the following problem is encountered: voids of micron order are liable to be generated at a boundary between granular solid phases in an aluminum cast product. This is for a reason which will be described below.

The known 238 alloy material has, because of a large content of Si, a thermal characteristic that in a first angled endothermic section in a differential calorimetric curve, the inclination of a rising line segment located between a rise-start point and a peak is gentle, resulting in an increased viscosity of a final solidified portion of the liquid phase and hence, the liquid phase is not sufficiently supplied to portions around the solid phase in response to the solidification and shrinkage of the solid phase.

SUMMARY OF THE INVENTION

It is an object of the present invention to provide a thixocasting process of the above-described type, which is capable of producing a cast product having a sound casting quality under a relatively low pressure.

To achieve the above object, according to the present invention, there is provided a thixocasting process comprising the steps of: subjecting to a heating treatment, an alloy material having a differential calorimetric curve in which a first angled endothermic section generated by the melting of a eutectic crystal and a second angled endothermic section generated by the melting of a component having a melting point higher than a eutectic point exist, thereby producing a semi-molten alloy material having a solid phase and a liquid phase coexisting therein, and pressing the semi-molten alloy material to conduct the charging of the semi-molten alloy material into a cavity in a casting mold and the subsequent solidification of the semi-molten alloy material under pressure, wherein the pressing step for the semi-molten alloy material is divided into a primary pressing stage and a secondary pressing stage which is subsequent to the primary pressing stage and at which a pressure larger than that at the primary pressing stage is applied, a start point of the primary pressing stage being established at a point when a temperature T of the semi-molten alloy material is in a range of $T_1<T\leqq T_4$ wherein $T_1$ is a temperature of a rise-start point in the first angled endothermic section and $T_4$ is a temperature of a peak in the second angled endothermic section, the charging of the semi-molten alloy material into the cavity in the casting mold being completed at the primary pressing stage, and a start point of the secondary pressing stage being established at a point when the temperature T of the semi-molten alloy material is in a range of $T_1<T\leqq T_3$ wherein $T_3$ is a temperature of a drop-end point in the first angled endothermic section, the semi-molten alloy material being solidified at the secondary pressing stage.

When the start point of the primary pressing stage is set as described above, the alloy material is maintained in the semi-molten state having solid and liquid phases coexisting therein at such start point and therefore, the alloy material is sequentially charged in a laminar flow manner into the cavity in the casting mold. This avoids the inclusion of air into the semi-molten alloy material.

The primary pressing stage is conducted for the purpose of charging the semi-molten alloy material into the cavity in the casting mold and therefore, the pressure at the primary pressing stage may be low. For example, the plunger pressure may be set in a range of 10 to 600 kg f/cm$^2$.

However, if the start point of the primary pressing stage established at a point when the temperature T of the semi-molten alloy material is in a range of $T>T_4$, the amount of the liquid phase in the semi-molten alloy material is excessive and hence, the material is liable to be injected into the cavity in the casting mold to cause the inclusion of air. On the other hand, when the start point is established at a point when the temperature T is in a range of $T\leqq T_1$, since $T_1$ is the solidifying temperature and permits the melting of the eutectic component to be started, the alloy material is brought into a substantially solid state, making it impossible to cast the alloy material.

On the other hand, when the start point of the secondary pressing stage is established as described above, the gelled layer around the outer periphery of the solid phase is in a solidified state, because the temperature $T_3$ of the drop-end point is a solidification-ending temperature of a high-melting component; and all of the eutectic component is in a liquid state at the temperature $T_3$. Therefore, the supplying of the liquid phase to portions around the solid phase is smoothly and sufficiently performed under a relatively low pressure, e.g., under a plunger pressure in a range of 100 to 1500 kg f/cm$^2$. Thus, it is possible to produce a cast product having a sound casting quality free of a shrinkage cavity.

However, if the start point of the secondary pressing stage is established at a point when the temperature T of the semi-molten alloy material is in a range of $T>T_3$, the supplying of the liquid phase to portions around the solid phase is obstructed by the gelled layer around the outer periphery of the solid phase and hence, a shrinkage cavity is liable to be generated under such plunger pressure. The same is true when $T \leqq T_1$.

In addition, it is an object of the present invention to provide a thixocasting process of the above-described type, in which both of the suppliablity of the liquid phase to portions around the solid phase and the compatibility between the solid and liquid phases can be improved, thereby producing a cast product which has no defects generated therein, which is sound and has high fatigue strength, toughness and strength.

To achieve the above object, according to the present invention, there is provided a thixocasting process comprising the steps of: preparing an alloy material having a thermal characteristic that a first angled endothermic section generated by the melting of a eutectic crystal and a second angled endothermic section generated by the melting of a component having a melting point higher than a eutectic point exist in a differential calorimetric curve, and the ratio $S_2/S_1$ of an area $S_2$ to an area $S_1$ is in a range of $0.09 \leqq S_2/S_1 \leqq 0.57$, the area $S_1$ being an area of a two-angled planar region surrounded by the first and second angled endothermic sections and a base line connecting a rise-start point in the first angled endothermic section and a drop-end point in the second angled endothermic section, and the area $S_2$ being an area of that single-angled planar region in the first angled endothermic section which is provided when the area $S_1$ of the two-angled endothermic section is bisected by a straight temperature line interconnecting a drop-end point in the first angled endothermic section and a temperature graduation of such drop-end point on a heating temperature axis; subjecting the alloy material to a heating treatment to produce a semi-molten alloy material; and subjecting the semi-molten alloy material to a casting procedure, wherein a casting temperature of the semi-molten alloy material is set in a range of $T_3 \leqq T \leqq T_4$, wherein $T_3$ is a temperature of the drop-end point of the first angled endothermic section, and $T_4$ is a temperature of a peak in the second angled endothermic section.

When the alloy material is subjected to the heating treatment, a semi-molten alloy material having liquid and solid phases coexisting therein is produced. In the semi-molten alloy material, the liquid phase has a large latent heat due to the fact that the area ratio $S_2/S_1$ is specified such that $S_2/S_1 \geqq 0.09$, as described above. As a result, at a solidifying step of the semi-molten alloy material, the liquid phase is sufficiently supplied to portions around the solid phase in response to solidification and shrinkage of the solid phase, and then, the liquid phase is solidified. The outer peripheral portions of the solid phase is in a gelled state due to the fact that the casting temperature (the temperature of the material during casting) T of the semi-molten alloy material is specified in the range of $T_3 \leqq T \leqq T_4$, as described above. This results in an improved compatibility between the gelled at the outer periphery of the solid phase and the liquid phase. Thus, it is possible to prevent the generation of voids of micron order in a cast product, thereby enhancing the strength and fatigue strength of the cast product.

Further, if the area ratio $S_2/S_1$ is set such that $S_2/S_1 \leqq 0.57$, the amount of precipitation of a hard and brittle eutectic component can be suppressed, thereby enhancing the toughness of a cast product.

However, if the area ratio $S_2/S_1$ is smaller than 0.09, the latent heat of the liquid phase is smaller and hence, the supplying of the liquid phase to portions around the solid phase is in sufficient when the solid phase is solidified and shrunk. As a result, voids of micron order are liable to be generated in the cast product. On the other hand, if the $S_2/S_1>0.57$, the amount of eutectic component crystallized is excessive and hence, the generation of the voids is avoided, but the toughness of the cast product is reduced. If the casting temperature T is lower than $T_3$, the outer peripheral portion of the solid phase cannot be gelled and as a result, the voids are liable to be generated in the cast product. On the other hand, If $T>T_4$, the semi-molten alloy material is lowered in viscosity and hence, the transportability of the semi-molten alloy material is degraded, and the semi-molten alloy material cannot be sequentially charged in a laminar flow manner. For this reason, blow holes are liable to be generated in a cast product due to the inclusion of air.

If the area ratio $S_2/S_1$ is set at a level smaller than 0.5, the shape retention of the semi-molten alloy material is improved, and the control of the material temperature is facilitated.

Further, it is another object of the present invention to provide a thixocasting alloy material of the above-described above, which is formed into a structure including a third solidified phase interposed between the first and second solidified phases and having a melting point intermediate between the melting points of the first and second solidified phases, whereby a cast product having a high strength can be produced from the thixocasting alloy material.

To achieve the above object, according to the present invention, there is provided a thixocasting alloy material which has a thermal characteristic that in a differential calorimetric curve, there are a first angled endothermic section generated by the melting of a first component having a eutectic composition, a second angled endothermic section generated by the melting of a second component having a melting point higher than a eutectic point, and a third angled endothermic section existing between the first and second angled endothermic sections due to the melting of a third component having a melting point higher than that of the first component and lower than that of the second component.

For the alloy material having the above-described thermal characteristic, at a solidifying step of a thixocasting process, the liquid phase formed by the third component is started to be solidified when the second component is in a gelled state, and then, the liquid phase formed by the first component is started to be solidified when the third component is in a gelled state.

As a result, in a cast product, the bondability between a second solidified phase formed by the second component and a third solidified phase formed by the third component is improved, and the bondability between the third solidified phase formed by the third component and a first solidified phase formed by the first component is also improved. Thus, the first and second solidified phases are firmly bonded to each other through the third solidified phase and hence, an increase in strength at ambient temperature and at a high temperature is achieved.

Yet further, it is an object of the present invention to provide an Al—Cu—Si based alloy material of the above-described type, from which an aluminum alloy cast product free of defects can be produced in a thixocasting process.

To achieve the above object, according to the present invention, there is provided a thixocasting Al—Cu—Si based alloy material which has a thermal characteristic such that a differential scanning calorimetry (DSC) of the alloy material produces a differential calorimetric curve having a first angled endothermic section generated by the melting of a eutectic crystal $CuAl_2$, and a second angled endothermic section generated by the melting of a primary crystal α-Al, and which has a Si content set in a range of 0.01% by weight $\leqq Si \leqq 1.5\%$ by weight.

If the Si content is set in the above-described range, the inclination of a rising line segment of the second angled endothermic section located between a drop-end point of the first angled endothermic section and a peak of the second angled endothermic section is gentle and hence, the gelled state of a solid phase is maintained for a relatively long time, thereby improving the bondability between the solid phases as well as between the solid and liquid phases.

On the other hand, in the first angled endothermic section, the inclination of a rising line segment located between a rise-start point and a peak is steep and hence, the viscosity of a finally solidified portion of the liquid phase is maintained low, thereby causing the liquid phase to be sufficiently supplied to potion around the solid phase in response to the solidification and shrinkage of the solid phase.

In such a manner, an aluminum alloy cast product which is free of defects, is sound and has excellent mechanical properties can be produced.

However, if the Si content is smaller than 0.01% by weight (including zero), the inclination of the rising line segment of the second angled endothermic section is steep and hence, the gelled state of the solid phase is maintained for a shortened time, resulting in a deteriorated bondability between the solid phases as well as between the solid and liquid phases.

On the other hand, if the Si content is larger than 1.5% by weight, the inclination of the rising line segment of the first angled endothermic section is gentle. For this reason, the viscosity of the finally solidified portion of the liquid phase is increased and hence, the liquid phase is not sufficiently supplied to portions around the solid phase in response to the solidification and shrinkage of the solid phase. As a result, voids of micron order are liable to be generated in an aluminum alloy cast product.

The above and other objects, features and advantages of the invention will become apparent from the following description of preferred embodiments taken in conjunction with the accompanying drawings.

DESCRIPTION OF THE PREFERRED EMBODIMENTS (First Embodiment)

Figure 1:
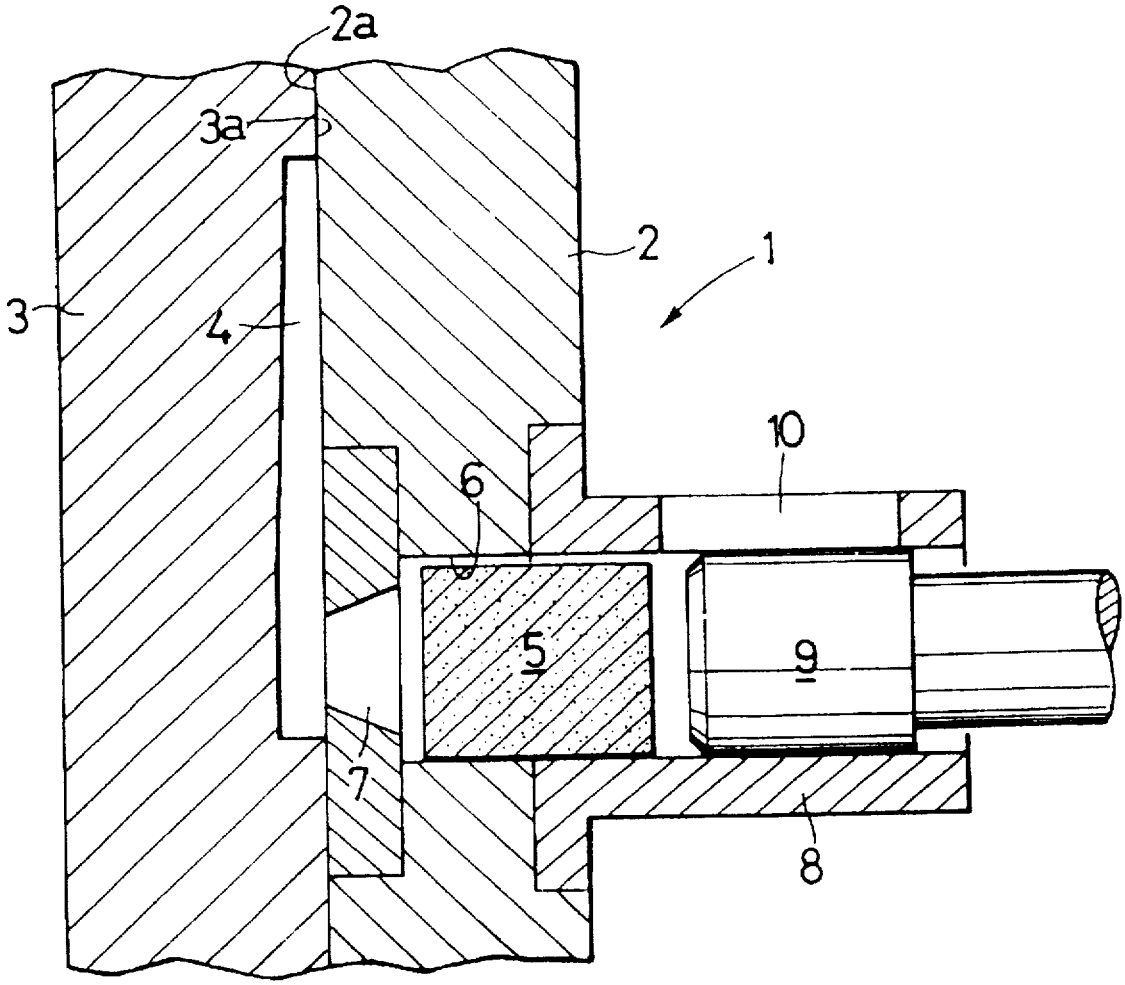
FIG. 1 is a vertical sectional view of one example of a pressure casting machine.

A pressure casting machine 1 shown in FIG. 1 is used to produce an aluminum alloy cast product in a thixocasting process using an aluminum alloy material (an alloy material). The pressure casting machine 1 includes a casting mold which is comprised of a stationary die 2 and a movable die 3 which have vertical mating surfaces 2*a* and 3*a*, respectively. A casting cavity 4 is defined between the mating surfaces 2*a* and 3*a*. A chamber 6, into which an aluminum alloy material 5 in a semi-molten state is placed, is defined in the stationary die 2 and communicates with the cavity 4 through a gate 7. A sleeve 8 is horizontally mounted to the stationary die 2 to communicate with the chamber 6, and a pressing plunger 9 is slidably received in the sleeve 8 for sliding movement into and out of the chamber 6. The sleeve 8 has a material inlet 10 in an upper portion of a peripheral wall thereof.

Figure 2:
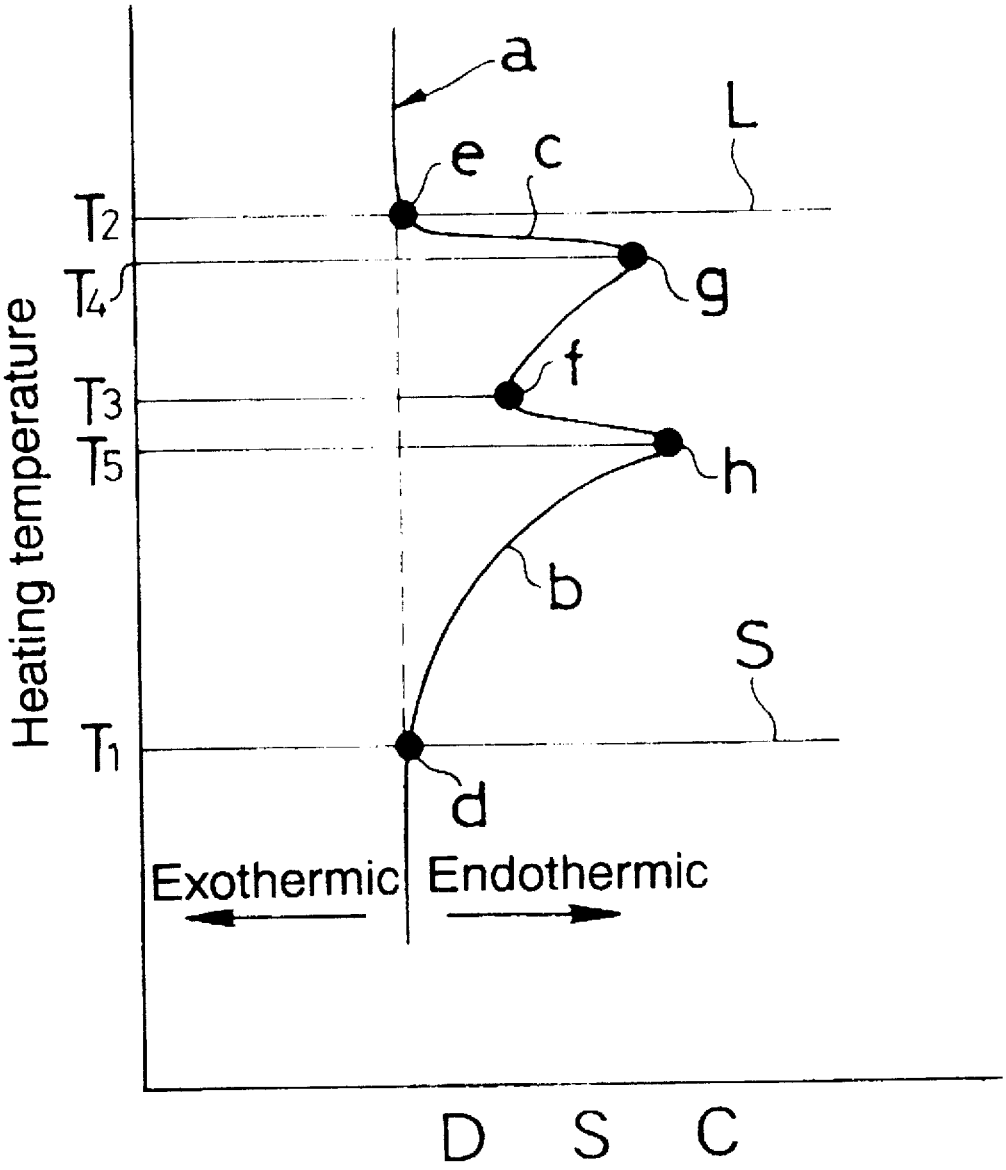
FIG. 2 is a differential calorimetric curve.

FIG. 2 shows a differential calorimetric curve a for an aluminum alloy material. In this differential calorimetric curve a, there are a first angled endothermic section b generated by the melting of a eutectic crystal, and a second angled endothermic section c generated by the melting of a component having a melting point higher than a eutectic point.

In the differential calorimetric curve a, a rise-start point d in the first angled endothermic section b corresponds to a solid phase line S in a phase diagram and therefore, the temperature $T_1$ of the rise-start point d is a melt-start temperature (a solidification-end temperature) of a eutectic component. A drop-end point e in the second angled endothermic section c corresponds to a liquid phase line L in the phase diagram and therefore, the temperature $T_2$ of the drop-end point e is a melt-end temperature (a solidification-start temperature) of a high-melting component.

The temperature $T_3$ of a drop-end point f in the first angled endothermic section b (a rise-start point in the second angled endothermic section c) is a melt-end temperature of the eutectic component (a melt-start temperature of the high-melting component).

In the production of the aluminum alloy cast product in the casting process, a procedure is employed which involves subjecting the aluminum alloy material 5 to a heating treatment to produce a semi-molten aluminum alloy material 5 having solid and liquid phases coexisting therein, placing the semi-molten aluminum alloy material 5 into the chamber 6, and performing the charging of the semi-molten aluminum alloy material 5 into the cavity 4 and the subsequent solidification of the semi-molten aluminum alloy material 5 under a pressure provided by the operation of the pressing plunger 9.

In this thixocasting process, the pressing step for the semi-molten aluminum alloy material 5 is divided into a primary pressing stage and a secondary pressing stage which is subsequent to the primary pressing stage and at which the pressure is larger than that at the primary pressing stage. The primary and secondary pressing stages are carried out by the pressing plunger 9.

A start point of the primary pressing stage is established at a point when the temperature T of the semi-molten aluminum alloy material 5 is in a range of $T_1 > T \leqq T_4$ wherein $T_1$ is a temperature of the rise-start point d in the first angled endothermic section b and $T_4$ is a temperature of a peak g in the second angled endothermic section c. During the primary pressing stage, the charging of the semi-molten aluminum alloy material 5 into the cavity 4 is completed.

A start point of the secondary pressing stage is established at a point when the temperature T of the semi-molten aluminum alloy material 5 is in a range of $T_1 < T \leqq T_3$ wherein $T_3$ is a temperature of the drop-end point f in the first angled endothermic section b. During the secondary pressing stage, the semi-molten aluminum alloy material 5 is solidified.

If the start point of the primary pressing stage is established as described above, the aluminum alloy material 5 is charged sequentially in a laminar flow manner, because the aluminum alloy material 5 is maintained in the semi-molten state having the solid and liquid phases coexisting therein at this start point. Thus, the inclusion of air into the semi-molten aluminum alloy material 5 is avoided.

The primary pressing stage is carried out for the purpose of charging the semi-molten aluminum alloy material 5 into the cavity 4 and hence, the pressure at the primary pressing stage may be low.

If the start point of the secondary pressing stage is established as described above, the supplying of the liquid phase to around the solid phases is smoothly and sufficiently performed under a relatively low pressure, because the temperature $T_3$ of the drop-end point f is the solidification-end temperature of the high-melting component; the gelled layer around the outer periphery of the solid phase is in a solidified state, and all of the eutectic component is in a liquid phase state at the temperature $T_3$. Thus, it is possible to produce an aluminum alloy cast product having a sound casting quality free of a shrinkage cavity.

When the secondary pressing is carried out in a high-die casting process, a waiting time is required after charging of a molten metal until the molten metal reaches a semi-solidified state. However, the aluminum alloy material 5 is in the semi-molten state at the time of completion of the primary pressing stage and therefore, after such completion, the secondary pressing stage can be immediately started. This is effective for enhancing the productivity of the aluminum alloy cast product.

The start point of the secondary pressing stage may be established at a point when the temperature T of the semi-molten aluminum alloy material 5 is in a range of $T_1<T\leqq T_5$ wherein $T_5$ is a temperature of a peak h in the first angled endothermic section b.

The reason why such a means is employed is as follows: even after the temperature has passed the drop-end point f in the first angled endothermic section b, the gelled layer around the outer periphery of the solid phase may remain due to a variability in casting conditions such as cooling rate. However, the gel layer is reliably solidified at the temperature $T_5$ of the peak h in the first angled endothermic section b and the amount of the liquid phase provided by the eutectic component is still large at this time point. Therefore, it is possible to produce an aluminum alloy cast product having a sound casting quality free of a shrinkage cavity.

Moreover, the start point of the secondary pressing stage is reliably prevented from exceeding or not exceeding the drop-end point f due to a slight displacement of timing and hence, the variability in quality of the aluminum alloy cast product can be avoided.

Figure 3:
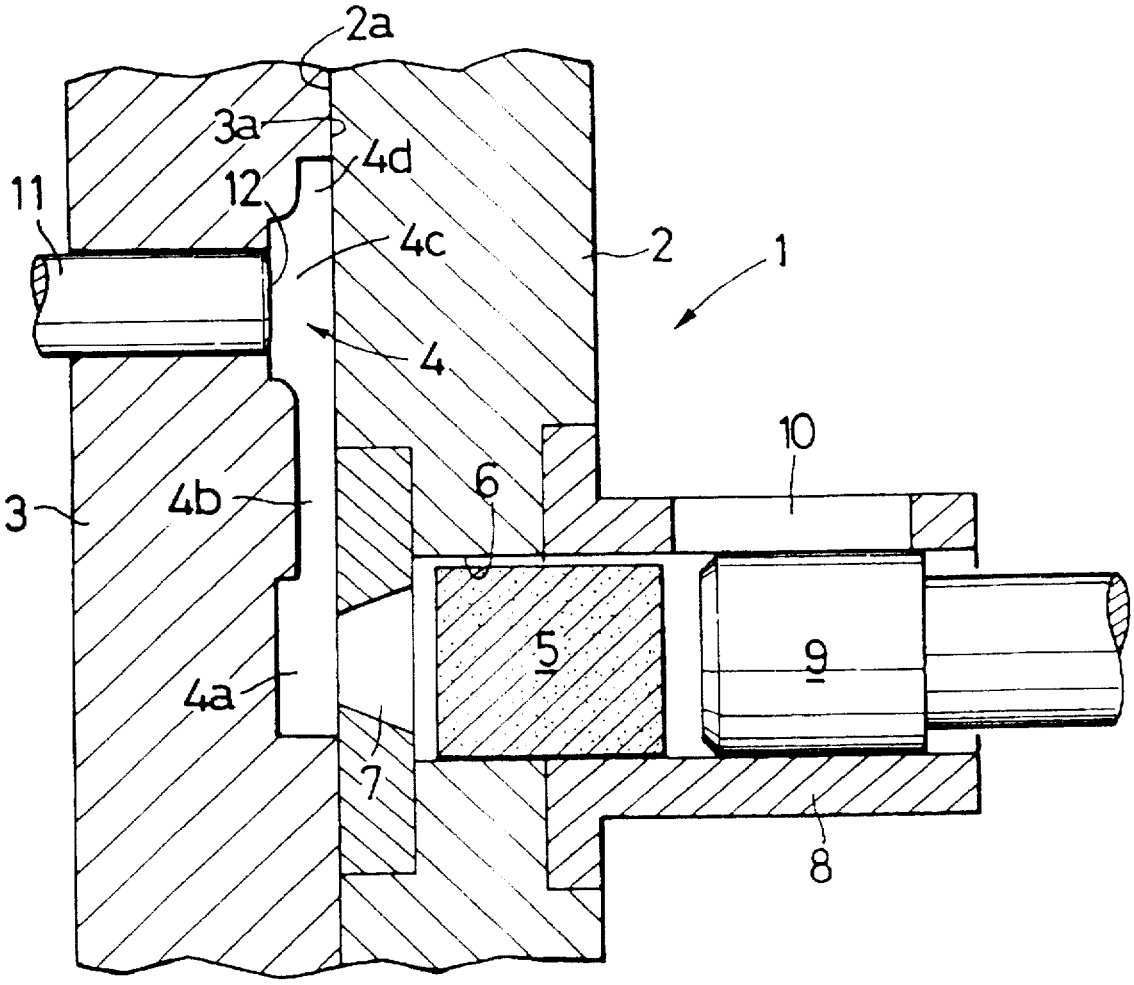
FIG. 3 is a vertical sectional view of another example of a pressure casting machine.

In a pressure casting machine shown in FIG. 3, a cavity 4 includes a first thick-portion forming region 4*a*, a first thin-portion forming region 4*b*, a second thick-portion forming region 4*c* and a second thin-portion forming region 4*d*, which are arranged such that they are sequentially farther and farther from a gate 7. In addition to a first pressing plunger 9 located on the side of a stationary die 2, a second pressing plunger 11 is mounted in a movable die 3 and has a tip end face 12 which faces the second thick-portion forming region 4*c*. The other construction of the pressure casting machine shown in FIG. 3 is the same as in the pressure casting machine shown in FIG. 1.

In this case, the first pressing plunger 9 is used for carrying out the primary pressing stage, and the second pressing plunger 11 is used for carrying out the secondary pressing stage. The use of the second pressing plunger 11 provides a partial forging effect for an aluminum alloy cast product, in addition to a liquid phase supplying effect as described above.

(1) Example 1

In the example 1, the pressure casting machine 1 shown in FIG. 1 is used, wherein the die-clamping force is of 200 tons, and the pressing force is of 20 tons. Table 1 shows the composition of an aluminum alloy material 5. This aluminum alloy material 5 is a material cut away from a long continuous cast product of a high quality produced in a continuous casting process. In the production of the long continuous cast product in the casting process, a spheroidizing of a primary crystal α-Al was performed. The aluminum alloy material 5 has a diameter of 50 mm and a length of 65 mm.

TABLE 1

| | Chemical constituent (% by weight) | | | | |
|---|---|---|---|---|---|
| | Si | Cu | Mg | Fe | Al |
| Al alloy material | 6.61 | 0.004 | 0.58 | 0.13 | balance |

Figure 4:
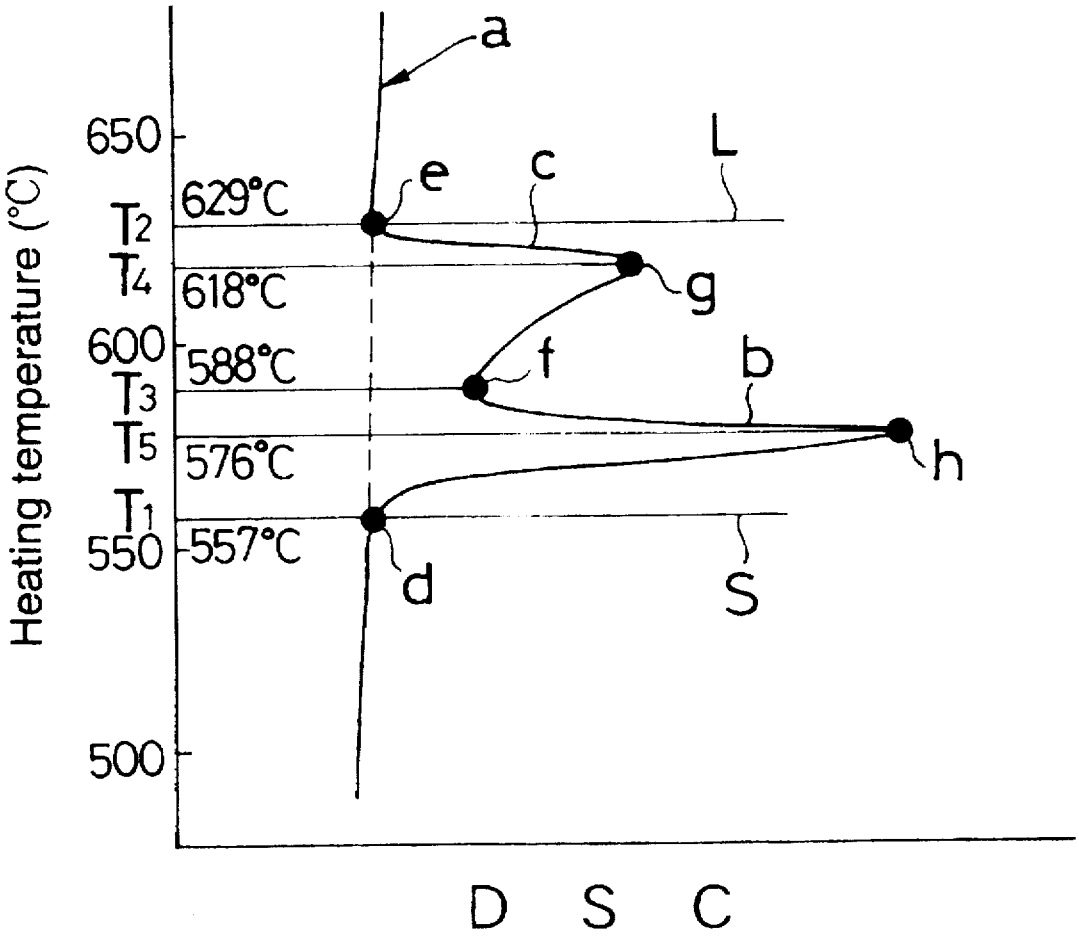
FIG. 4 shows a first example of a differential calorimetric curve.

The aluminum alloy material 5 was subjected to a differential scanning calorimetry (DSC) to provide the results shown in FIG. 4. In a differential calorimetric curve a, the temperature $T_1$ of a rise-start point d in a first angled endothermic section b is equal to 557° C.; the temperature $T_5$ of a peak h is equal to 576° C.; the temperature $T_3$ of a drop-end point f is equal to 588° C.; the temperature $T_4$ of a peak g in a second angled endothermic section c generated by the melting of a component having a melting point higher than a eutectic point is equal to 618° C.; and the temperature $T_2$ of a drop-end point e is equal to 629° C.

The aluminum alloy material 5 was placed into a heating coil in an induction heating apparatus and then heated under conditions of a frequency of 1 kHz and an output of 37 kW to produce a semi-molten aluminum alloy material 5 having solid and liquid phases coexisting therein. In this case, the heating temperature for the semi-molten aluminum alloy material 5 is 595° C., and the solid phase content is 40%.

Then, the semi-molten aluminum alloy material 5 was placed into the chamber 6, as shown in FIG. 1, and the primary pressing stage was started under conditions of a temperature T of the alloy material 5 of 595° C., a moving speed of the pressing plunger 9 of 0.5 m/sec, a gate-passing speed of the semi-molten aluminum alloy material 5 of 3 m/sec, and a die temperature of 250° C., thereby causing the material 5 to be charged through the gate 7 into the cavity 4 while being pressed.

Figure 5:
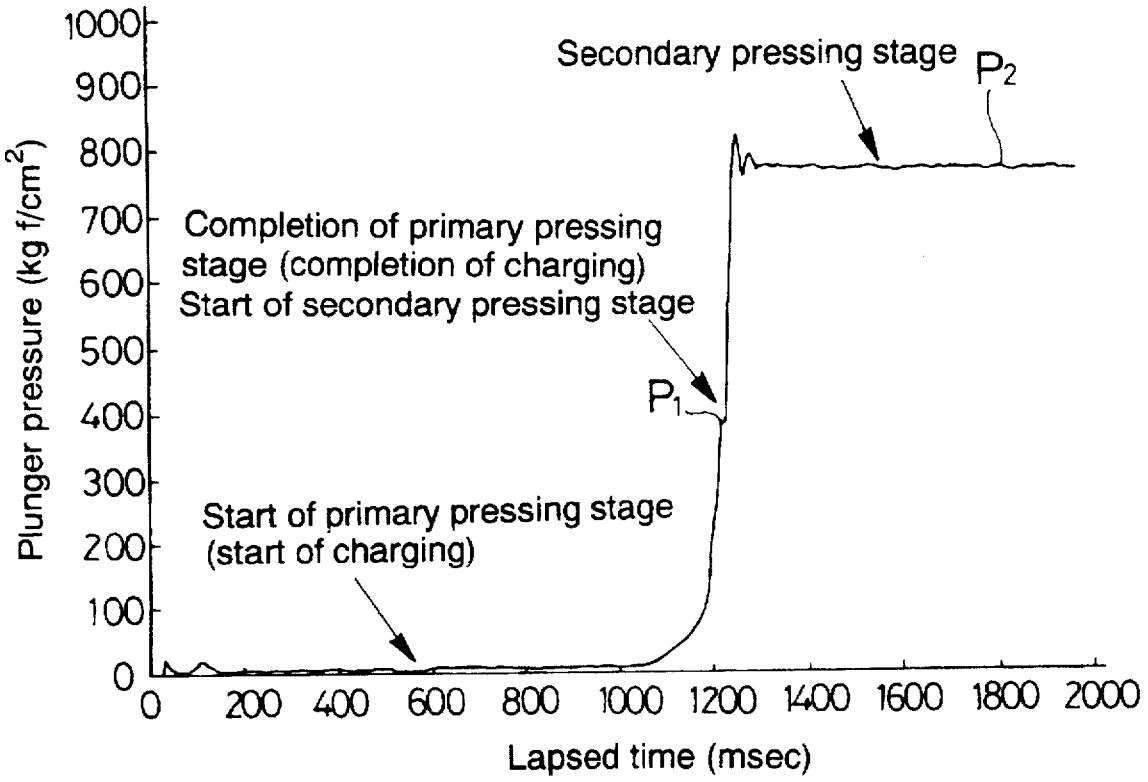
FIG. 5 is a graph showing one example of the relationship between the lapsed time and the plunger pressure.

At the time of completion of the primary pressing stage, the temperature T of the semi-molten aluminum alloy material 5 was equal to 570° C., and the plunger pressure $P_1$ was set at 360 kg f/cm$^2$, as shown in FIG. 5.

Figure 6:
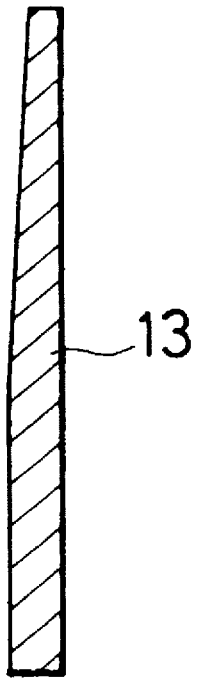
FIG. 6 is a vertical sectional view of one example of an aluminum alloy cast product.

After the completion of the primary pressing stage, the secondary pressing stage for the semi-molten aluminum alloy material 5 was immediately started by the pressing plunger 9, thereby solidifying the semi-molten aluminum alloy material 5 at the secondary pressing stage to provide an aluminum alloy cast product 13 shown in FIG. 6.

The temperature T of the semi-molten aluminum alloy material 5 at the start point of the secondary pressing stage was equal to 570° C. ($T_1<T\leqq T_3$ and especially, $T\leqq T_5$). On the other hand, the plunger pressure $P_2$ at the secondary pressing stage was set at 760 kg f/cm$^2$ and the pressure-maintaining duration was set at 20 seconds, as shown in FIG. 5.

Figure 7:
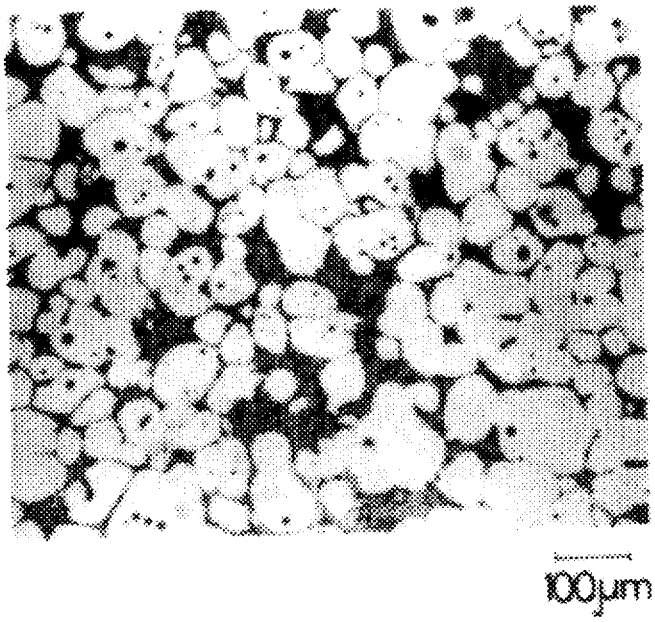
FIG. 7 is a photomicrograph showing a first example of the metallographic structure of an aluminum alloy cast product.
Figure 8:
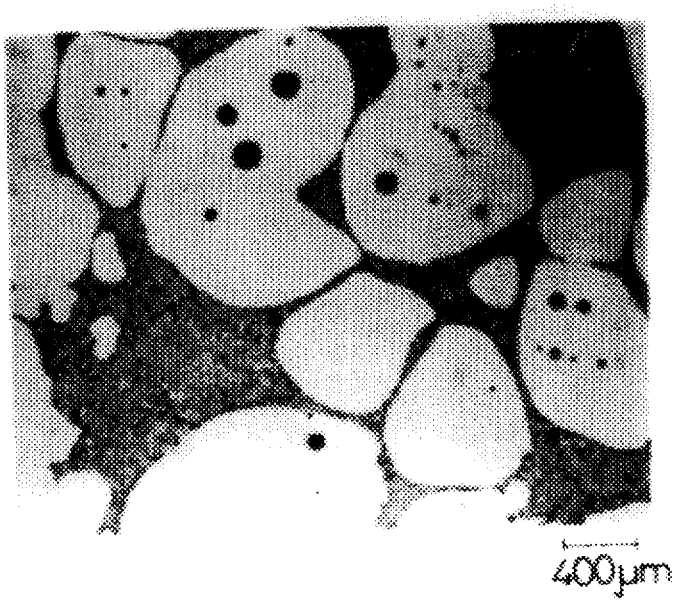
FIG. 8 is an enlargement of a portion of the photograph of FIG. 7.

FIGS. 7 and 8 are photomicrographs showing a metallographic structure of the aluminum alloy cast product 13, FIG. 8 corresponding to an enlarged portion of the photograph taken from FIG. 7. As is apparent from FIGS. 7 and 8, there is no shrinkage cavity generated around the granular solid phases in the aluminum alloy cast product 13 and therefore, the aluminum alloy cast product 13 has a sound casting quality.

In this case, the plunger pressure $P_2$ at the secondary pressing stage is equal to 760 kg f/cm$^2$ and may be substantially low, as compared with the conventional plunger pressure of 950 kg f/cm$^2$.

For comparison, an aluminum alloy cast product was produced using a semi-molten aluminum alloy material 5 similar to that described above in the same manner, except that only the primary pressing stage was carried out.

Figure 9:
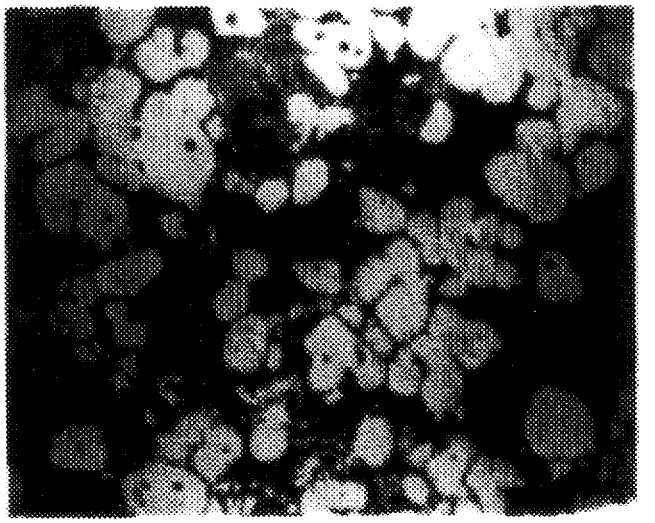
FIG. 9 is a photomicrograph showing a second example of the metallographic structure of an aluminum alloy cast product.

FIG. 9 is a photomicrograph showing the metallographic structure of such aluminum alloy cast product. It can be seen from FIG. 9 that there are shrinkage cavities (black portions) generated around a large number of granular solid phases. This is due to a low plunger pressure $P_1$ at the primary pressing stage.

In addition, for comparison, an aluminum alloy cast product was produced in a thixocasting process under the same conditions as those described above, except for the use of a semi-molten aluminum alloy material which has a thermal characteristic that a single angled endothermic section appears in a differential calorimetric curve and which contains no eutectic component, e.g., JIS 6061.

Figure 10:
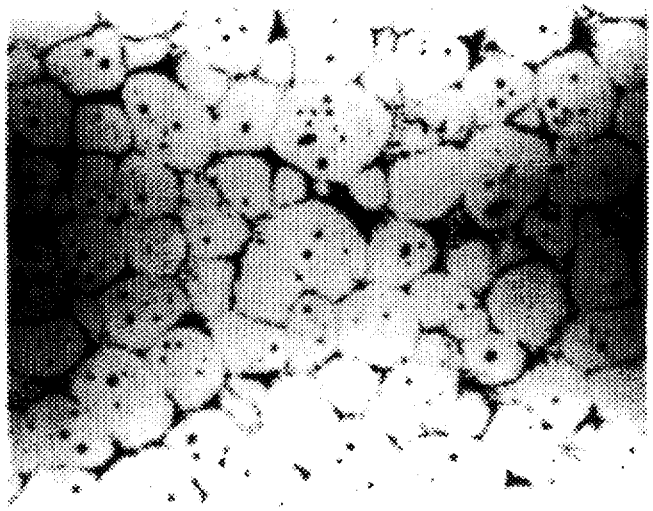
FIG. 10 is a photomicrograph showing a third example of the metallographic structure of an aluminum alloy cast product.

FIG. 10 is a photomicrograph showing the metallographic structure of such aluminum alloy cast product. It can be seen from FIG. 10 that there are shrinkage cavities generated around a large number of granular solid phases. This is due to the fact that the supplying of the liquid phase to portions around each of the solid phases was not performed, because no eutectic component was contained in the aluminum alloy material.

(2) Example 2

In the example 2, the pressure casting machine shown in FIG. 3 is used, wherein the die-clamping force is 200 tons, and the pressing force is 20 tons. Table 2 shows the composition of an aluminum alloy material 5. This aluminum alloy material 5 is a material cut away from a long continuous cast product of a high quality produced in a continuous casting process. In the production of the long continuous cast product in the casting process, a spheroidizing of a primary crystal α-Al was performed. The aluminum alloy material 5 has a diameter of 50 mm and a length of 65 mm.

TABLE 2

| | Chemical constituent (% by weight) | | | | | | |
|---|---|---|---|---|---|---|---|
| | Si | Cu | Mg | Fe | Zn | Mn | Al |
| Al alloy material | 5.30 | 2.95 | 0.32 | 0.12 | 0.01 | 0.01 | balance |

Figure 11:
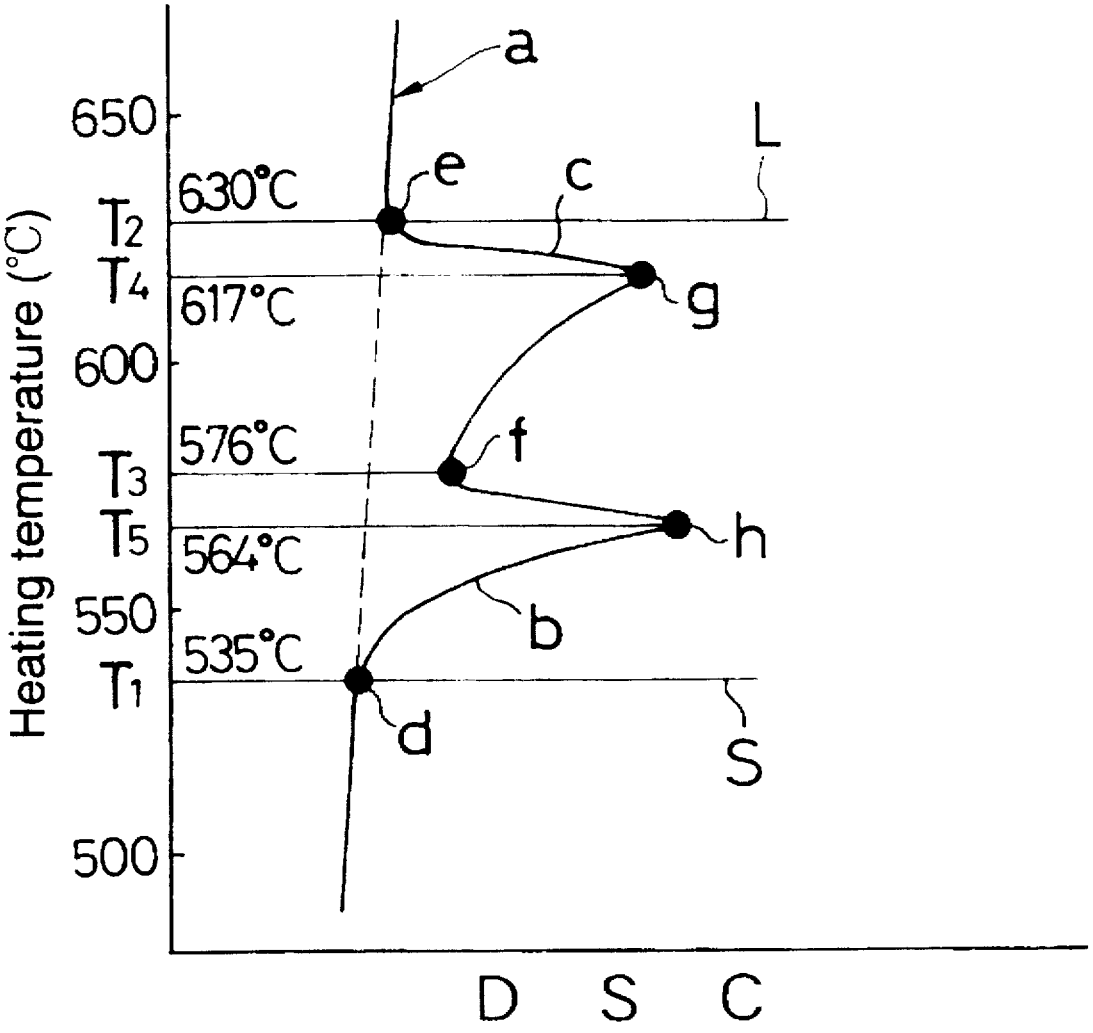
FIG. 11 shows a second example of a differential calorimetric curve.

The aluminum alloy material 5 was subjected to a differential scanning calorimetry (DSC) to provide results shown in FIG. 11. In a differential calorimetric curve a shown in FIG. 11, the temperature $T_1$ of a rise-start point d in a first angled endothermic section b is equal to 535° C.; the temperature $T_5$ of a peak h is equal to 564° C.; the temperature $T_3$ of a drop-end point f is equal to 576° C.; the temperature $T_4$ of a peak g in a second angled endothermic section c generated by the melting of a component having a melting point higher than a eutectic point is equal to 617° C.; and the temperature $T_2$ of a drop-end point e is equal to 630° C.

The aluminum alloy material 5 was placed into a heating coil in an induction heating apparatus and then heated under conditions of a frequency of 1 kHz and an output of 37 kW to produce a semi-molten aluminum alloy material 5 having solid and liquid phases coexisting therein. In this case, the heating temperature for the semi-molten aluminum alloy material 5 is 595° C., and the solid phase content is 47%.

Then, the semi-molten aluminum alloy material 5 was placed into the chamber 6, as shown in FIG. 3, and the primary pressing stage was started under conditions of a temperature T of the material 5 of 595° C. ($T_1<T\leqq T_4$), a moving speed of the pressing plunger 9 of 0.3 m/sec, a gate-passing speed of the semi-molten aluminum alloy material 5 of 2 m/sec, and a die temperature of 250° C., thereby causing the material 5 to be charged through the gate 7 into the cavity 4 while being pressed.

Figure 12:
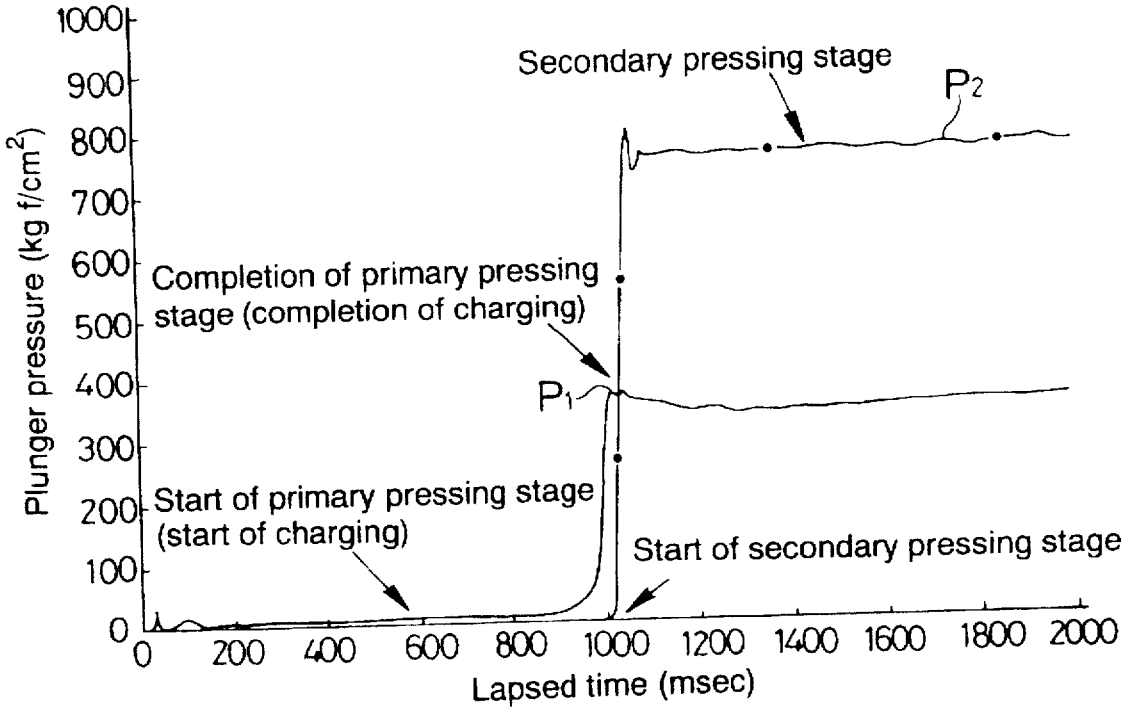
FIG. 12 is a graph showing another example of the relationship between the lapsed time and the plunger pressure.

At the time of completion of the primary pressing stage, the temperature T of the semi-molten aluminum alloy material 5 was equal to 568° C., and the plunger pressure $P_1$ was set at 360 kg f/cm$^2$, as shown in FIG. 12. In this case, the first pressing plunger 9 was retained at its pressing position even after the completion of the primary pressing stage.

Figure 13:
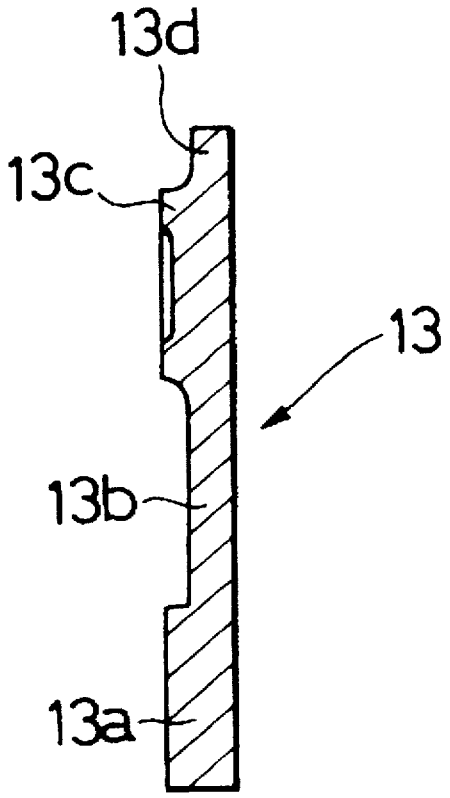
FIG. 13 is a vertical sectional view of another example of an aluminum alloy cast product.

After the completion of the primary pressing stage, the secondary pressing stage for the semi-molten aluminum alloy material 5 was immediately started by the second pressing plunger 11, thereby solidifying the semi-molten aluminum alloy material 5 at the secondary pressing stage to provide an aluminum alloy cast product 13 shown in FIG. 13.

The temperature T of the semi-molten aluminum alloy material 5 at the start point of the secondary pressing stage was equal to 568° C. ($T_1<T\leqq T_3$). On the other hand, the plunger pressure $P_2$ provided at the secondary pressing stage by the second pressing plunger 11 was set at 760 kg f/cm$^2$ and the pressure-maintaining duration was set at 20 seconds.

Figure 14:
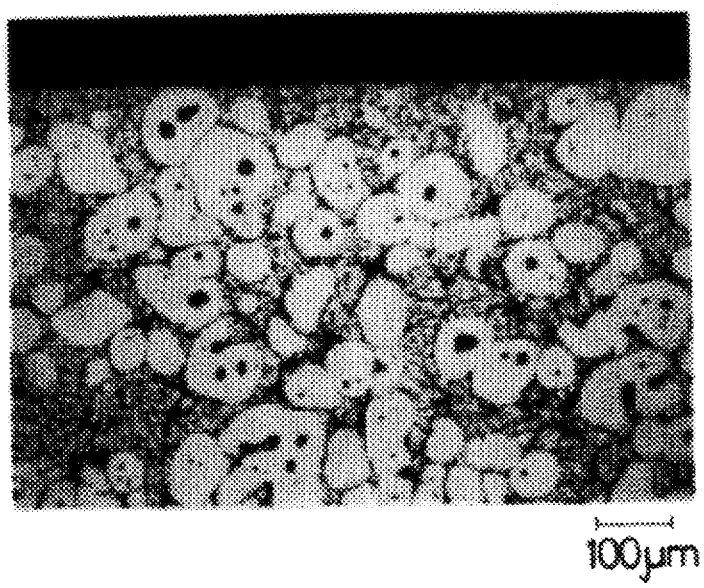
FIG. 14 is a photomicrograph showing a fourth example of the metallographic structure of an aluminum alloy cast product.
Figure 15:
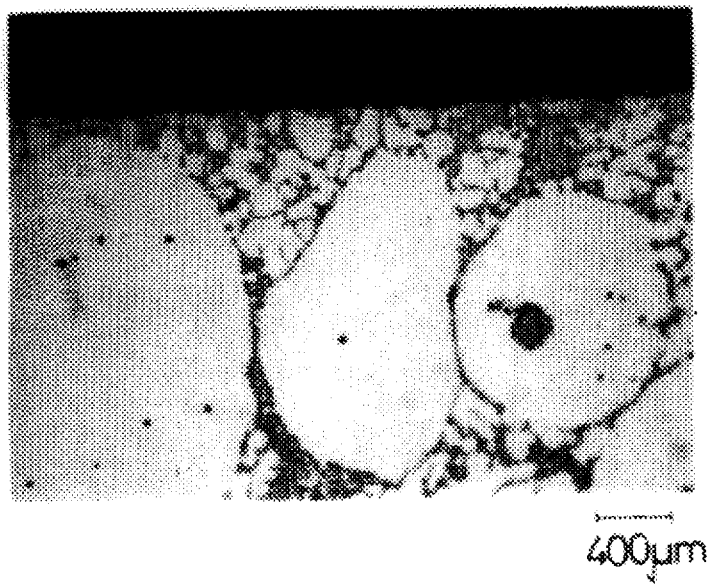
FIG. 15 is an enlargement of a portion of the photograph of FIG. 14.

FIGS. 14 and 15 are photomicrographs showing the metallographic structure of a first thick portion 13*a* of the aluminum alloy cast product 13, FIG. 15 corresponding to an enlarged portion of the photograph taken from FIG. 14. As is apparent from FIGS. 14 and 15, there is no shrinkage cavity generated around granular solid phases, and therefore, the first thick portion 13*a* has a sound casting quality. The same is true of first and second thin portions 13*b* and 13*d* and a second thick portion 13*c*.

Figure 16:
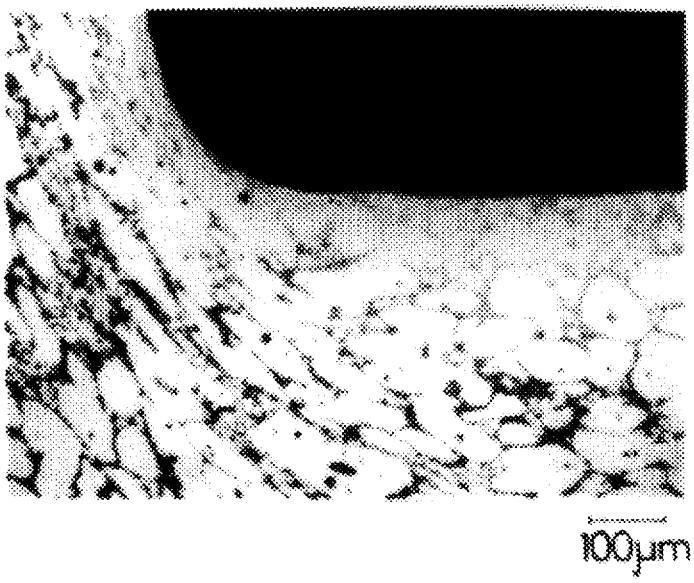
FIG. 16 is a photomicrograph showing a fifth example of the metallographic structure of an aluminum alloy cast product.
Figure 17:
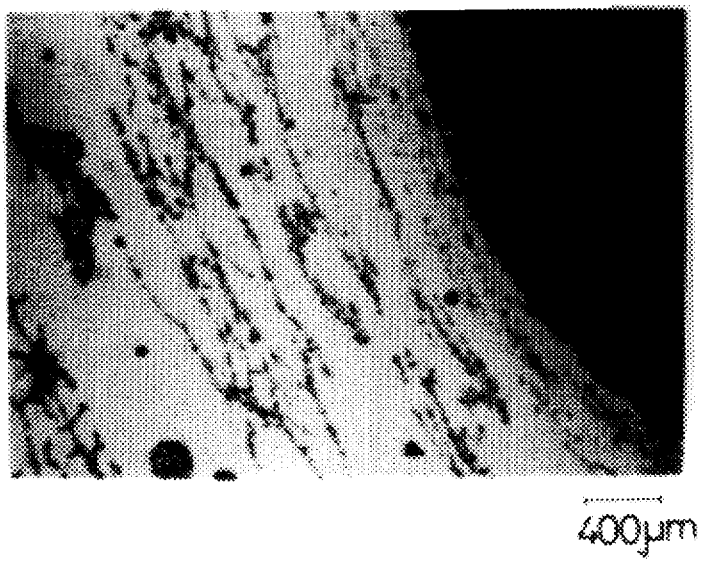
FIG. 17 is an enlargement of a portion of the photograph of FIG. 16.

FIGS. 16 and 17 are photomicrographs showing the metallographic structure of the second thick portion 13*c* in the vicinity of the second pressing plunger 11, FIG. 17 corresponding to an enlarged portion of the photograph taken from FIG. 16. As is apparent from FIGS. 16 and 17, it can be seen that the large number of granular solid phases were plastically deformed into a flat shape, thereby providing a partial forging effect by the second pressing plunger 11.

Then, the aluminum alloy cast product was subjected to a T6 treatment, i.e., a solution treatment which comprises a heating at 515° C. for 5 hours and a subsequent water-cooling, as well as to an aging treatment involving a heating at 170° C. for 10 hours.

Thereafter, fatigue test pieces were fabricated from the first and second thick portions 13*a* and 13*c* of the aluminum alloy cast product and subjected to a tension-compression fatigue test to provide the results given in Table 3.

TABLE 3

| | Fatigue strength σ (B10) (MPa) |
|---|---|
| First thick portion | 132 |
| Second thick portion | 140 |

As is apparent from Table 3, the fatigue strength of the second thick portion 13*c* is about 6% higher than that of the first thick portion 13*a*. This is attributable to the forging effect provided by the second pressing plunger 11.

The alloy material in the first embodiment is not limited to the aluminum alloy material.

(Second Embodiment)

Table 4 shows compositions of examples $A_1$, $A_2$ and $A_3$ and comparative examples $a_1$, $a_2$ and $a_3$ of aluminum alloy materials. Each of these examples $A_1$ and the like is a material cut away from a long continuous cast product produced in a continuous casting process. In the production of such long continuous cast product, a spheroidizing of a primary crystal α-Al was performed. Each of the examples $A_1$ and the like has a diameter of 50 mm and a length of 65 mm.

TABLE 4

| Al alloy material | Chemical constituent (% by weight) | | | | |
|---|---|---|---|---|---|
| | Si | Cu | Mg | Fe | Balance |
| $A_1$ | 1.1 | — | 1.9 | 0.96 | Al |
| $A_2$ | 0.19 | 4.64 | 0.23 | 0.28 | Al |
| $A_3$ | 7.02 | — | 0.28 | 0.13 | Al |
| $a_1$ (6061 material) | 0.62 | 0.33 | 0.91 | 0.6 | Al |
| $a_2$ (A357 material) | 7.43 | — | 0.58 | 0.13 | Al |
| $a_3$ (AC2B material) | 5.73 | 3.35 | 0.54 | 0.92 | Al |

Figure 18:
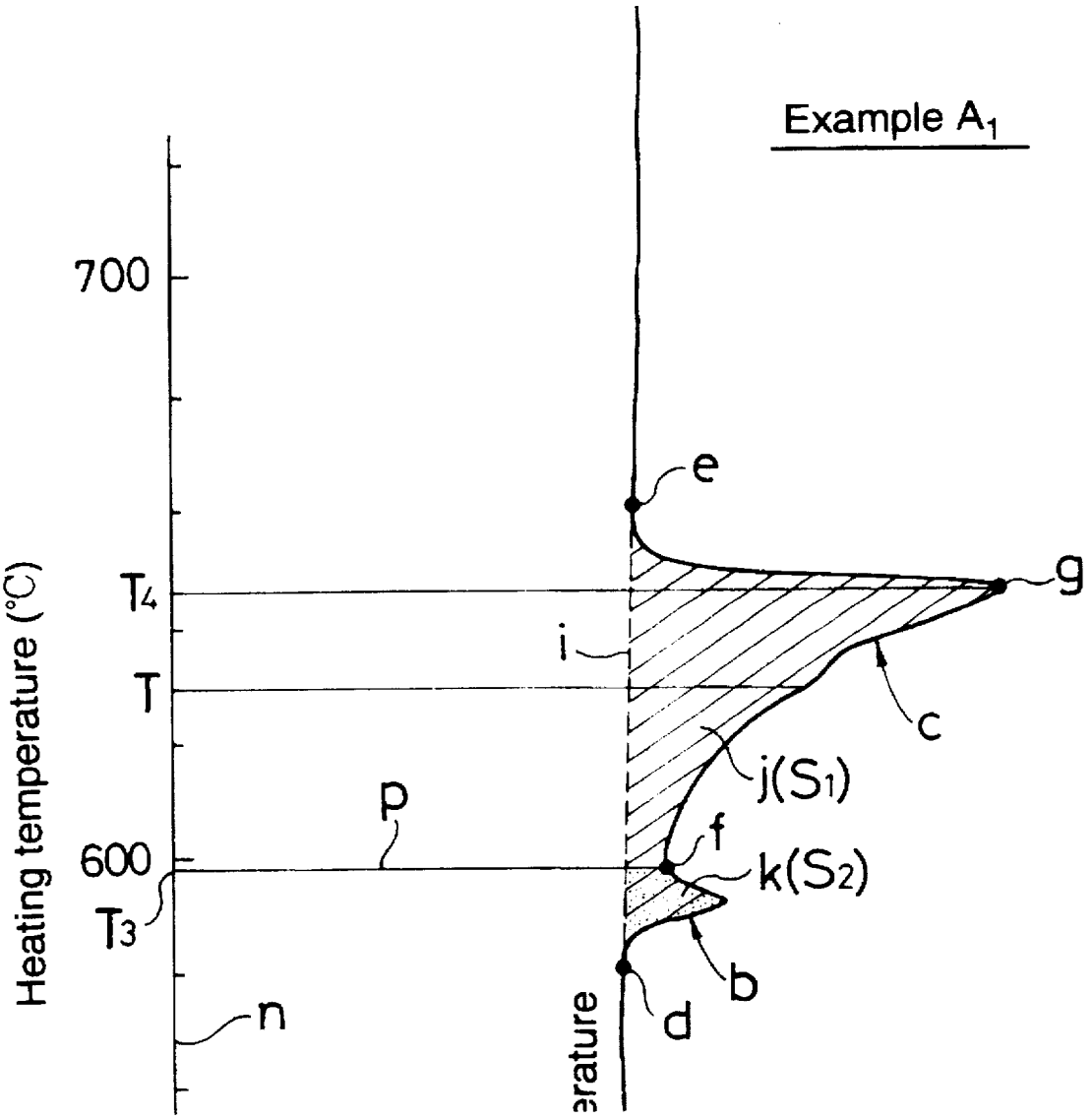
FIG. 18 shows a third example of a differential calorimetric curve.

The example $A_1$ was subjected to a differential scanning calorimetry (DSC) to provide a result shown in FIG. 18. In a differential calorimetric curve a shown in FIG. 18, there are a first angled endothermic section b generated by the melting of a eutectic crystal, and a second angled endothermic section c generated by the melting of a component having a melting point higher than a eutectic point. In this case, an area $S_1$ of a two-angled planar region (which is an obliquely lined region in FIG. 18) j surrounded by the first angled endothermic section b, the second angled endothermic section c, a base line interconnecting a rise-start point in the first angled endothermic section b and a drop-end point e in the second angled endothermic section c is equal to 1,500 $mm^2$. When the area $S_2$ of the two-angled planar region j is bisected by a straight temperature line p interconnecting a drop-end point f in the first angled endothermic section b and a temperature graduation of the drop-end point f on a heating temperature axis n, an area $S_2$ of a single-angled planar region (a dotted region in FIG. 18) k defined by the first angled endothermic section b is equal to 135 $mm^2$. Thus, the ratio $S_2/S_1$ of the area $S_2$ of the single-angled planar region k to the area of the two-angled planar region $S_1$ is equal to 0.09.

Then, the example $A_1$ was placed into a heating coil in an induction heating apparatus and then heated under conditions of a frequency of 1 kHz and an output of 30 kW to produce an example $A_1$ in a semi-molten state having solid and liquid phases coexisting therein. In this case, the solid phase content is set in a range of 40% (inclusive) to 60% (inclusive).

Thereafter, the example $A_1$ (designated by reference character 5) in the semi-molten state was placed into the chamber 6 and charged through the gate 7 into the cavity 4 while being pressed under conditions of a casting temperature T of the example $A_1$ of 630° C., a moving speed of the pressing plunger 9 of 0.20 m/sec, and a die temperature of 250° C., thereby causing the material 5. Then, a pressing pressure was applied to the example $A_1$ filled in the cavity 4 by retaining the pressing plunger 9 at a stroke end, and the example $A_1$ was solidified under such applied pressure to provide an aluminum alloy cast product $A_1$. In this case, the temperature $T_3$ of the drop-end point f in the first angled endothermic section b in FIG. 18 is equal to 598° C., and the temperature $T_4$ of the peak g in the second angled endothermic section c is equal to 645° C. Therefore, a relation, $T_3 \leqq T \leqq T_4$ is established, because the casting temperature of the example $A_1$ in the semi-molten state is equal to 630° C.

The examples $A_2$ and $A_3$ and the comparative examples $a_1$, $a_2$ and $a_3$ were subjected to a differential scanning calorimetry (DSC), and were further used to produce five aluminum alloy cast products by a casting operation similar to that described above. FIGS. 19 to 23 show differential calorimetric curves a for the examples $A_2$ and $A_3$ and the comparative examples $a_1$, $a_2$ and $a_3$, respectively.

Table 5 shows information obtained from the differential calorimetric curves a, and mechanical properties for the aluminum alloy cast products, $A_1$, $A_2$, $A_3$, $a_1$, $a_2$ and $a_3$.

TABLE 5

| Al alloy cast product | Differential calorimetric curve | | | | | | Al alloy cast product | | |
|---|---|---|---|---|---|---|---|---|---|
| | Area $S_1$ of two-angled planar region ($mm^2$) | Area $S_2$ of single-angled planar region ($mm^2$) | Area ratio $S_2/S_1$ | Temperature $T_3$ (°C.) of drop-end point f | Temperature $T_4$ (°C.) of peak g | Casting temperature (°C.) | Presence or absence of defects | Charpy impact value ($J/cm^2$) | Tensile strength (MPa) |
| $A_1$ | 1500 | 135 | 0.09 | 598 | 645 | 630 | absence | 14.8 | 312 |
| $A_2$ | 1730 | 170 | 0.10 | 606 | 658 | 630 | absence | 14.3 | 361 |
| $A_3$ | 1750 | 1000 | 0.57 | 596 | 625 | 600 | absence | 9.7 | 297 |
| $a_1$ | — | — | — | — | — | 640 | presence | 15.6 | 296 |
| $a_2$ | 2030 | 1220 | 0.60 | 593 | 621 | 580 | absence | 4.7 | 333 |
| $a_3$ | 1740 | 1340 | 0.77 | 587 | 604 | 580 | absence | 1.5 | 290 |

FIGS. 24 to 29 are photomicrographs showing the metallographic structures of the aluminum alloy cast products $A_1$, $A_2$, $A_3$, $a_1$, $a_2$ and $a_3$, respectively.

Figure 19:
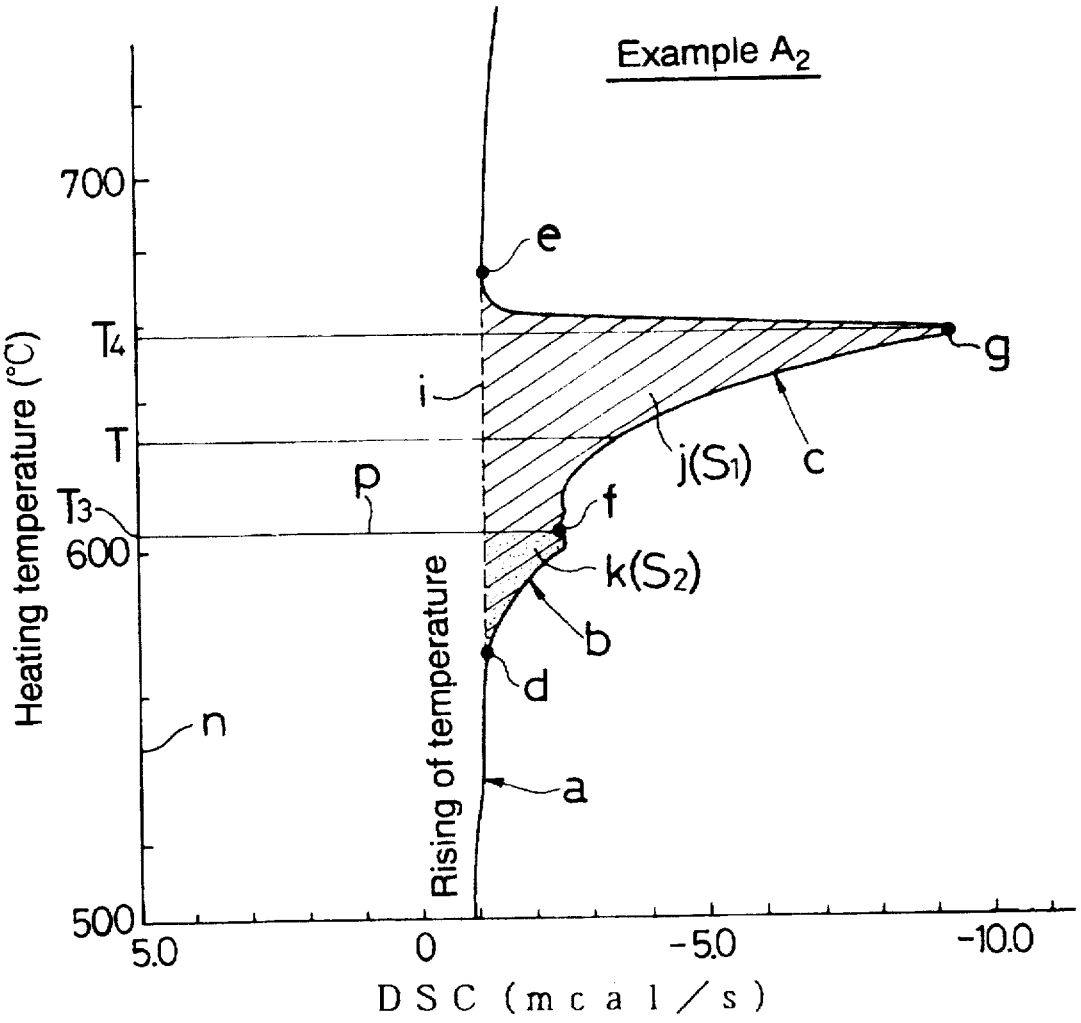
FIG. 19 shows a fourth example of a differential calorimetric curve.
Figure 20:
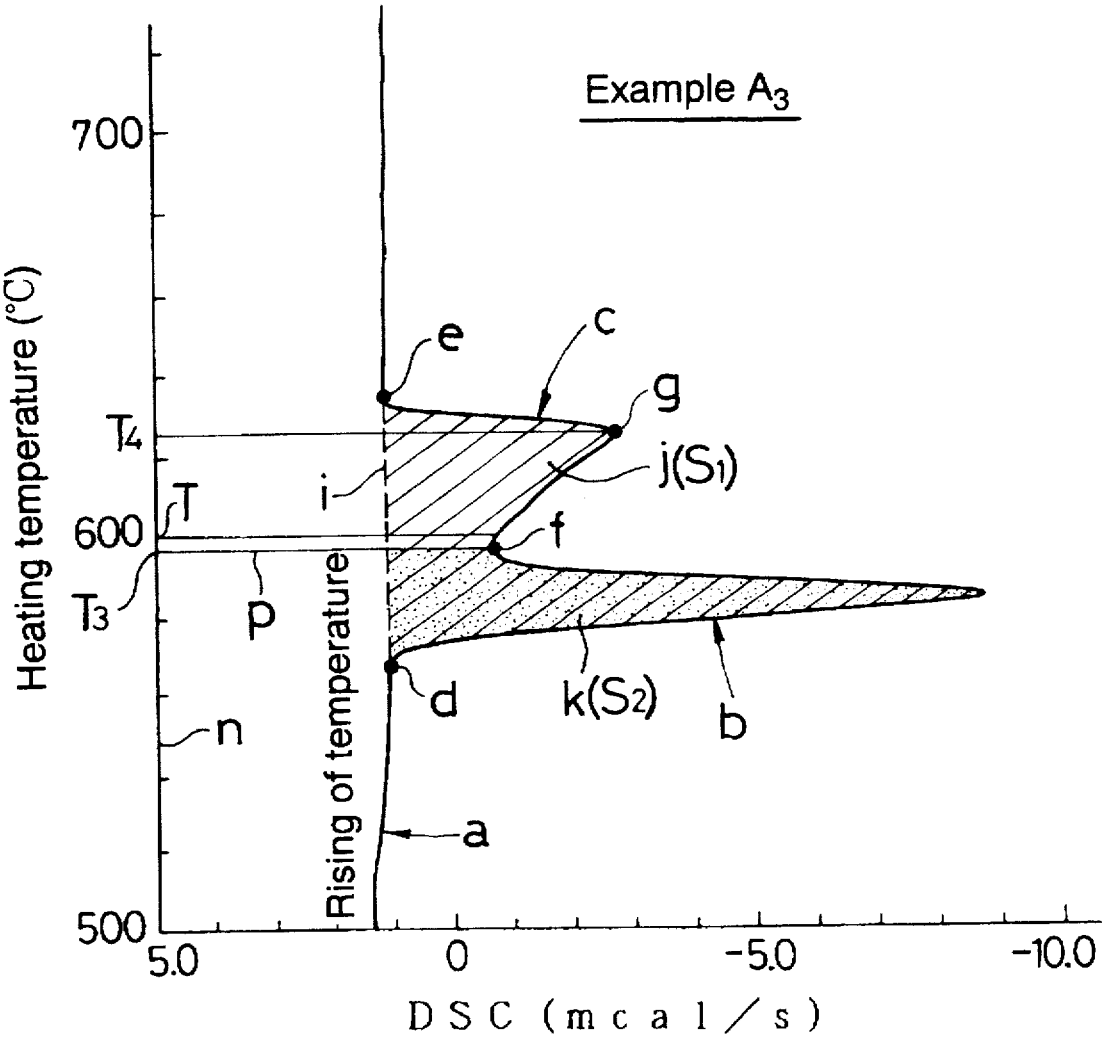
FIG. 20 shows a fifth example of a differential calorimetric curve.
Figure 24:
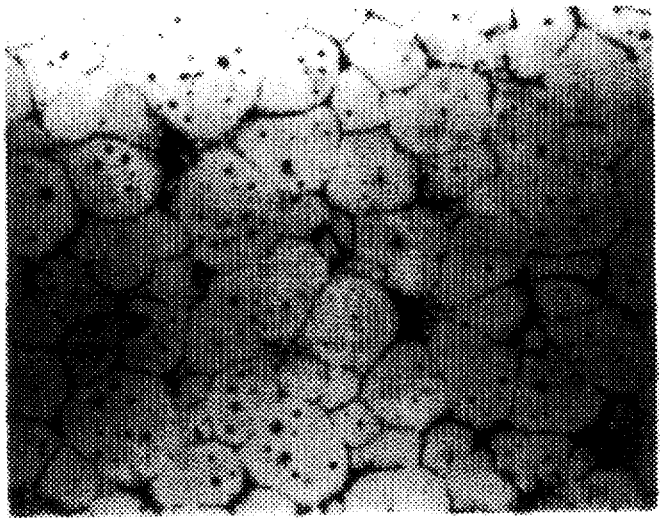
FIG. 24 is a photomicrograph showing a sixth example of the metallographic structure of an aluminum alloy cast product.
Figure 25:
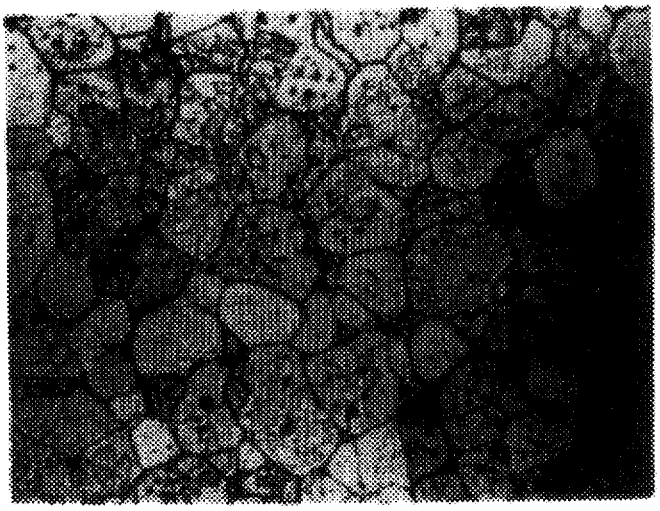
FIG. 25 is a photomicrograph showing a seventh example of the metallographic structure of an aluminum alloy cast product.
Figure 26:
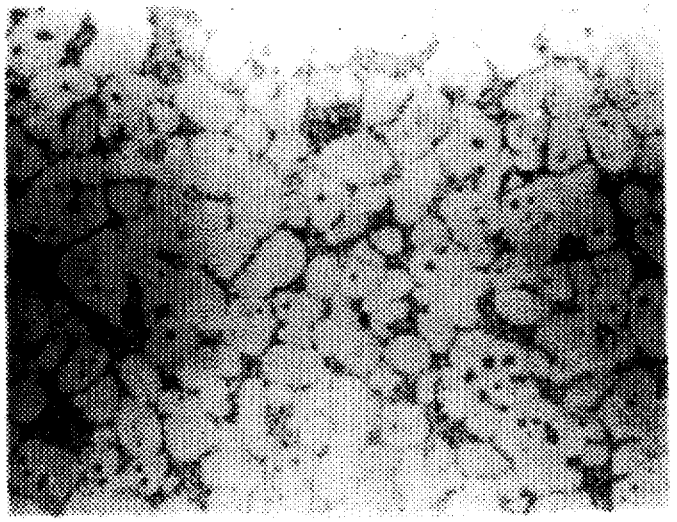
FIG. 26 is a photomicrograph showing an eighth example of the metallographic structure of an aluminum alloy cast product.

As is apparent from FIGS. 18 to 20, Table 5 and FIGS. 24 to 26, each of the aluminum alloy cast products $A_1$, $A_2$ and $A_3$ has a high fatigue strength, because of no defects generated therein, and has a high toughness and a high strength, because of a high Charpy impact value.

Figure 30:
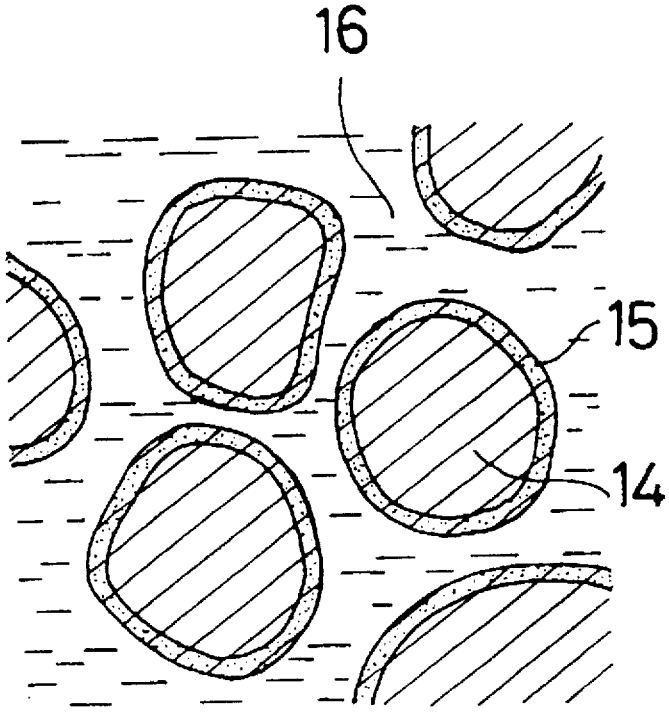
FIG. 30 is a diagram showing a semi-molten state of an aluminum alloy material.

This is for the following reason: in the examples $A_1$, $A_2$ and $A_3$ in the semi-molten states, the liquid phase has a large latent heat due to the fact that the area ratio $S_2/S_1$ is specified in a range of $S_2/S_1 \geqq 0.09$, as described above. As a result, at the solidifying step for the examples $A_1$, $A_2$ and $A_3$ in the semi-molten states, the liquid phase is sufficiently supplied to portions around the solid phase in response to the solidification and shrinkage of the solid phase, and then solidified. In addition, the portion 15 around the outer periphery of the solid phase 14 is gelled, as shown in FIG. 30, due to the fact that the casting temperature T for the examples $A_1$, $A_2$ and $A_3$ in the semi-molten states is specified in a range of $T_3 \leqq T \leqq T_4$, as described above. This results in an improved compatibility of the gelled portion 15 around the outer periphery of the solid phase 14 with the liquid phase 16. Thus, it is possible to prevent the generation of voids of micron order in the aluminum alloy cast products $A_1$, $A_2$ and $A_3$ to enhance the strength and the fatigue strength of the aluminum alloy cast products $A_1$, $A_2$ and $A_3$.

Further, if the area ratio $S_2/S_1$ is set in a range of $S_2/S_1 \leqq 0.57$, it is possible to suppress the amount of crystallization of a hard and brittle eutectic component in the aluminum alloy cast products $A_1$, $A_2$ and $A_3$, thereby enhancing the toughness of the aluminum alloy cast products $A_1$, $A_2$ and $A_3$.

Figure 21:
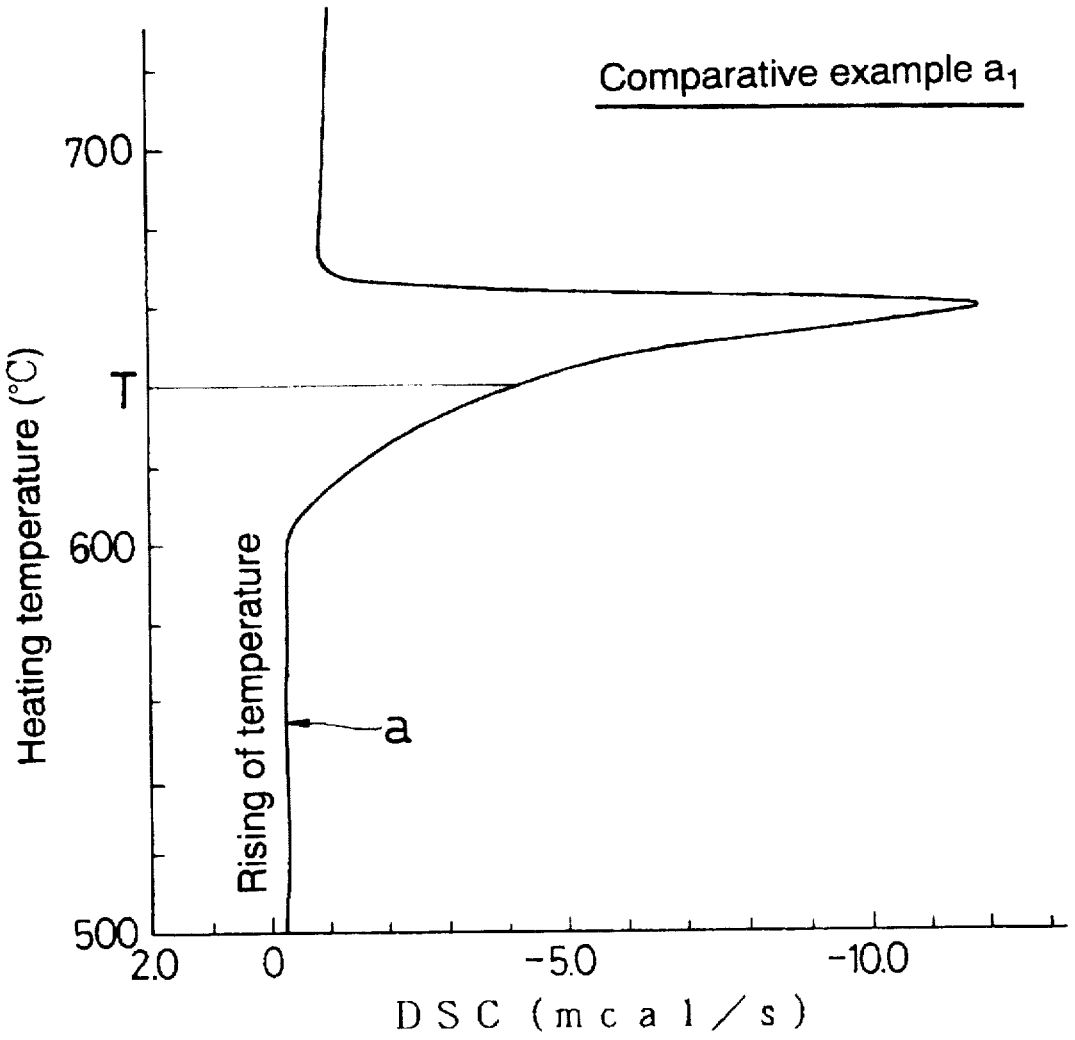
FIG. 21 shows a sixth example of a differential calorimetric curve.
Figure 22:
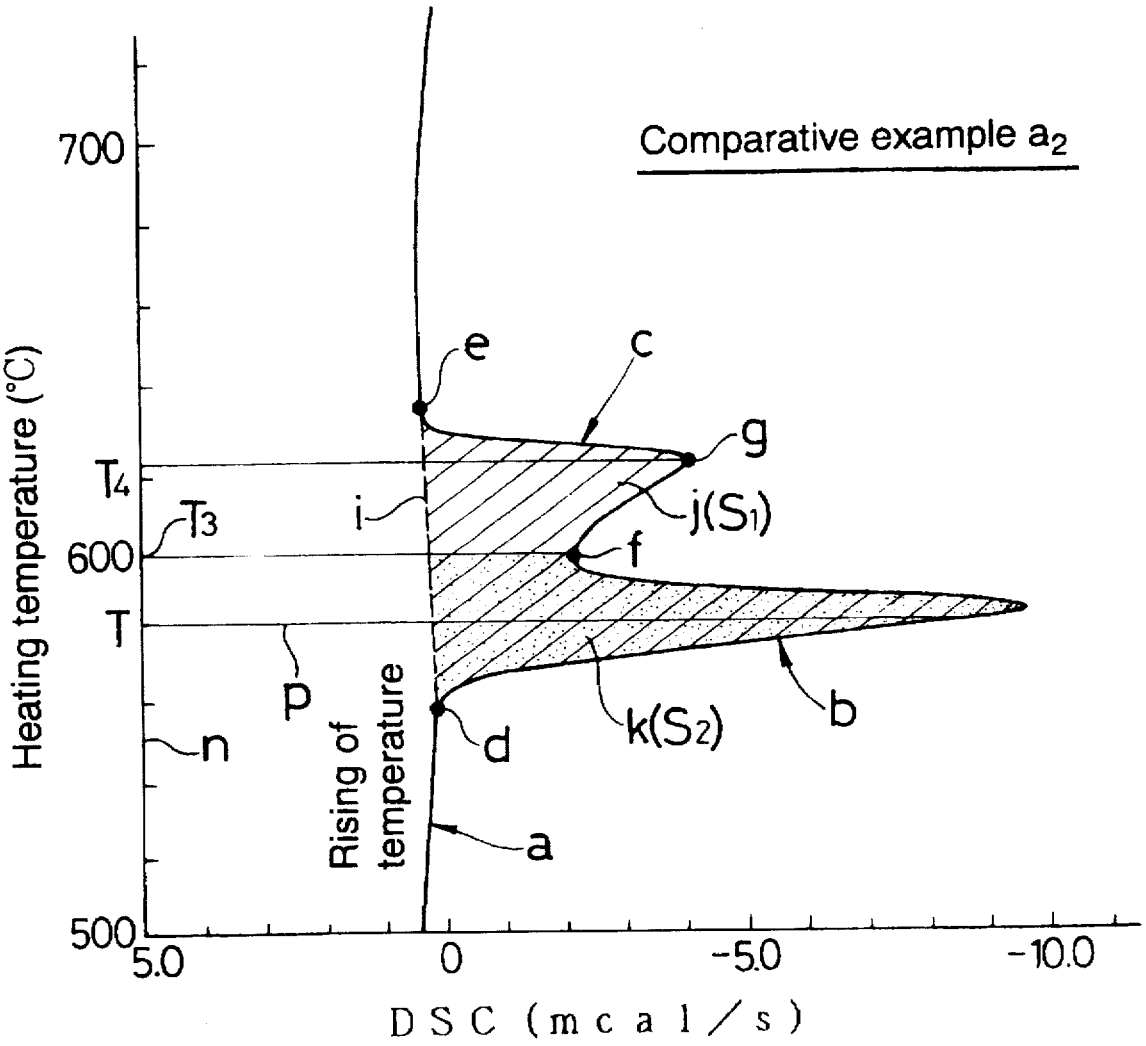
FIG. 22 shows a seventh example of a differential calorimetric curve.
Figure 23:
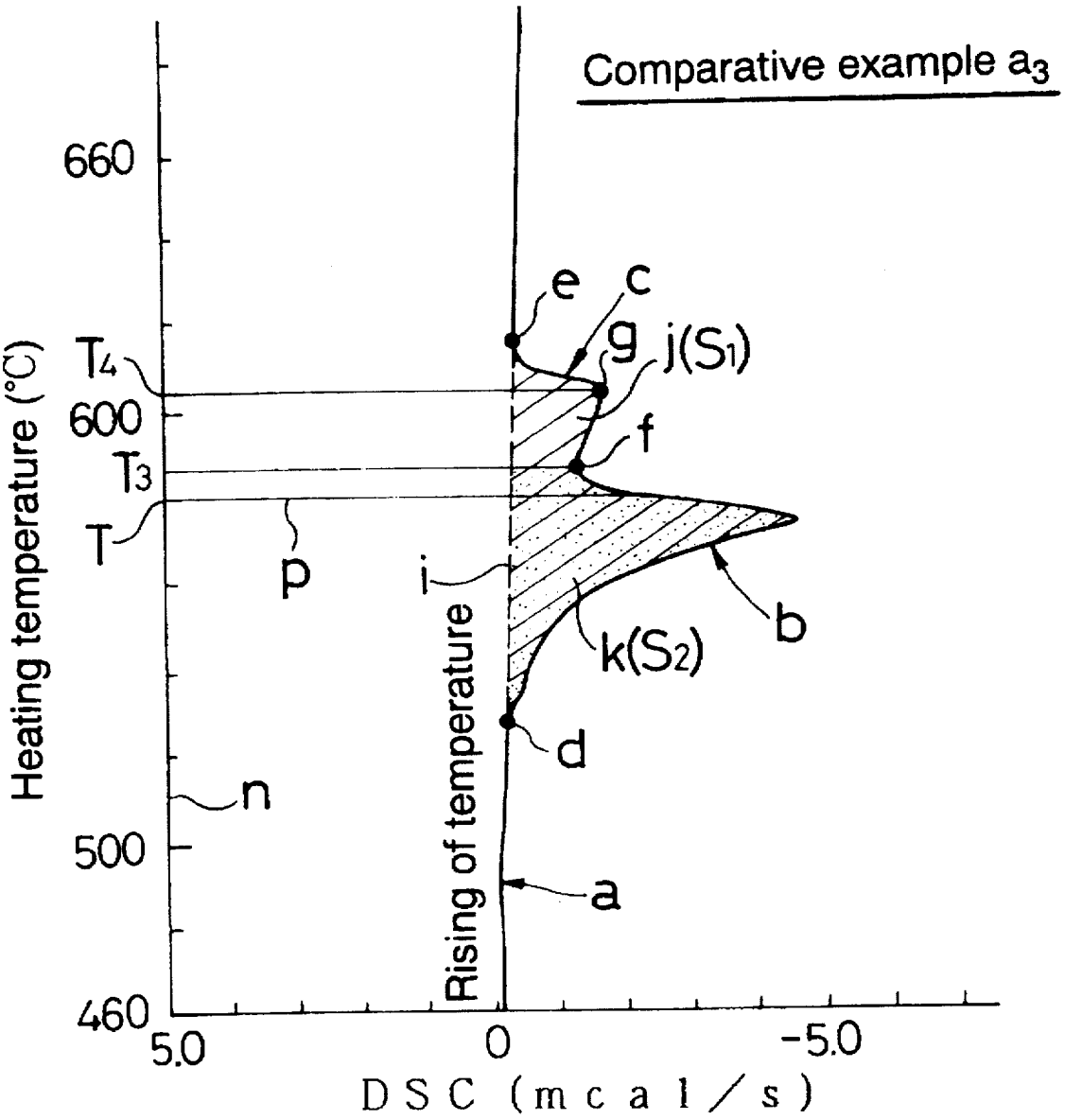
FIG. 23 shows an eighth example of a differential calorimetric curve.
Figure 27:
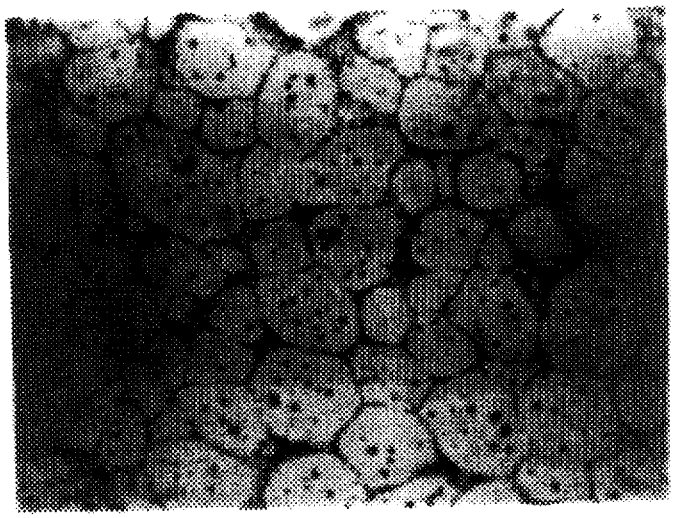
FIG. 27 is a photomicrograph showing a ninth example of the metallographic structure of an aluminum alloy cast product.

The aluminum alloy cast product $a_1$, shown in FIG. 27 has a low fatigue strength and a low strength, because there are voids of micron order (black island-like portions) generated at a grain boundary due to the fact that the comparative example $a_1$ has little amount of a eutectic component, as can be seen from FIG. 21.

Figure 28:
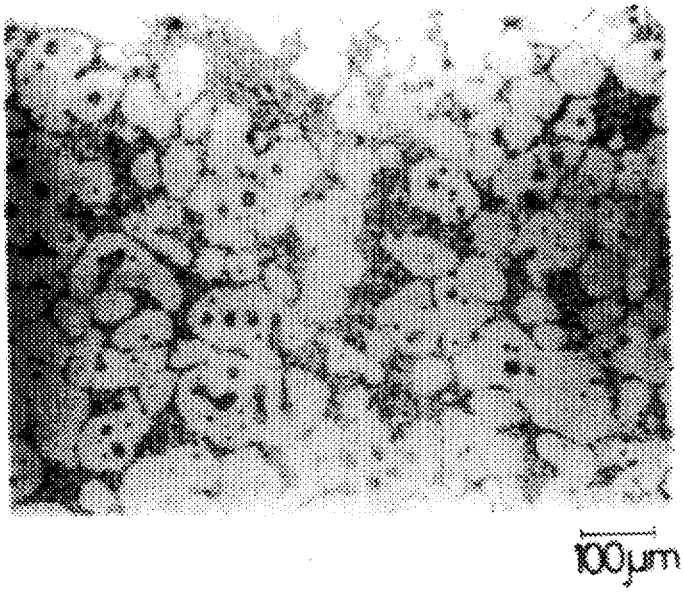
FIG. 28 is a photomicrograph showing a tenth example of the metallographic structure of an aluminum alloy cast product.
Figure 29:
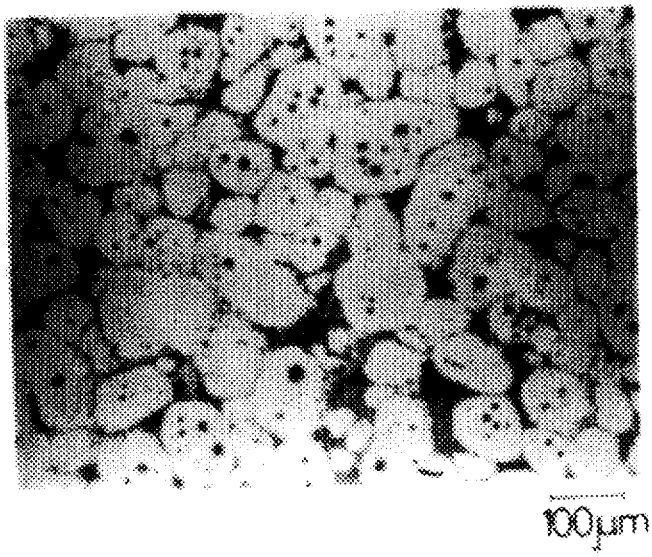
FIG. 29 is a photomicrograph showing an eleventh example of the metallographic structure of an aluminum alloy cast product.

The aluminum alloy cast products $a_2$ and $a_3$ shown in FIGS. 28 and 29 have a low toughness and a low strength, because the amount of eutectic component crystallized is relative large, and the portion around the outer periphery of the solid phase is not gelled, due to the fact that the area ratio $S_2/S_1$ is larger than 0.57 and the casting temperature T is lower than $T_3$, and moreover, because the grain size of the α-Al in the aluminum alloy cast product $a_3$ is large.

The alloy material in the second embodiment is not limited to the aluminum alloy material.

(Third Embodiment) (1) Example 1

Table 6 shows the compositions of the example $A_1$ and the comparative example $a_1$ of the aluminum alloy material. The aluminum alloy material having such a composition is effective as a casting material for an aluminum alloy cast product which is used at ambient temperature. Each of the example $A_1$ and the comparative example $a_1$ is a material cut away from a long continuous cast product produced in a continuous casting process. In the production of the long continuous cast product, a spheroidizing of a primary crystal α-Al was performed. Each of the example $A_1$ and the comparative example $a_1$ has a diameter of 50 mm and a length of 65 mm.

TABLE 6

| Al alloy | Chemical constituent (% by weight) | | | | |
|---|---|---|---|---|---|
| material | Si | Mg | Fe | Mn | Balance |
| $A_1$ | 7.02 | 0.57 | 0.44 | 0.18 | Al |
| $a_1$ | 7.03 | 0.57 | 0.09 | — | Al |

Figure 31:
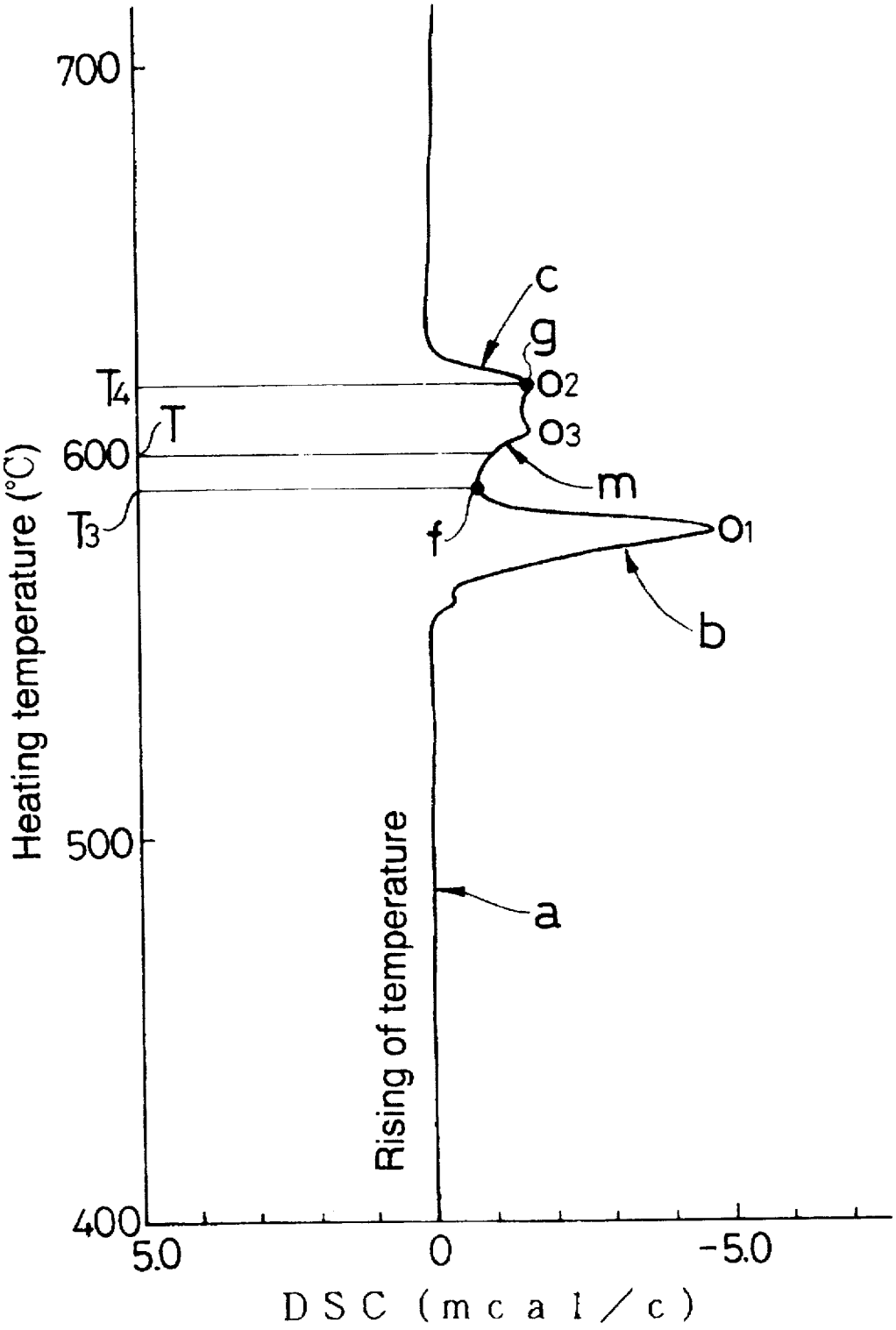
FIG. 31 shows a ninth example of a differential calorimetric curve.

The example $A_1$ was subjected to a differential scanning calorimetry (DSC) to provide a result shown in FIG. 31. In the differential calorimetric curve a shown in FIG. 31, there is a first angled endothermic section b generated by the melting of a first component having a eutectic composition, a second angled endothermic section c generated by the melting of a second component having a melting point higher than a eutectic point, and a third angled endothermic section m existing between the first and second angled endothermic sections b and c due to the melting of a third component having a melting point higher than that of the first component and lower than that of the second component. In this case, a relation, $o_1 > o_2$ and $o_3$, is established between a peak value $o_1$ of the first angled endothermic section b and peak values $o_2$ and $o_3$ of the second and third angled endothermic sections c and m, and a relation, $o_2 \approx o_3$, is established between the peak values $o_2$ and $o_3$ of the second and third angled endothermic sections c and m.

In the example $A_1$, the first component is a eutectic crystal AlSi having a melting point of 575° C.; the second component is α-Al having a melting point of 619° C.; and the third component is an intermetallic compound (a mixture of $Al_{15}(Mn, Fe)Si_2$ and $Al_5FeSi$] having a melting point of 594° C.

Figure 32:
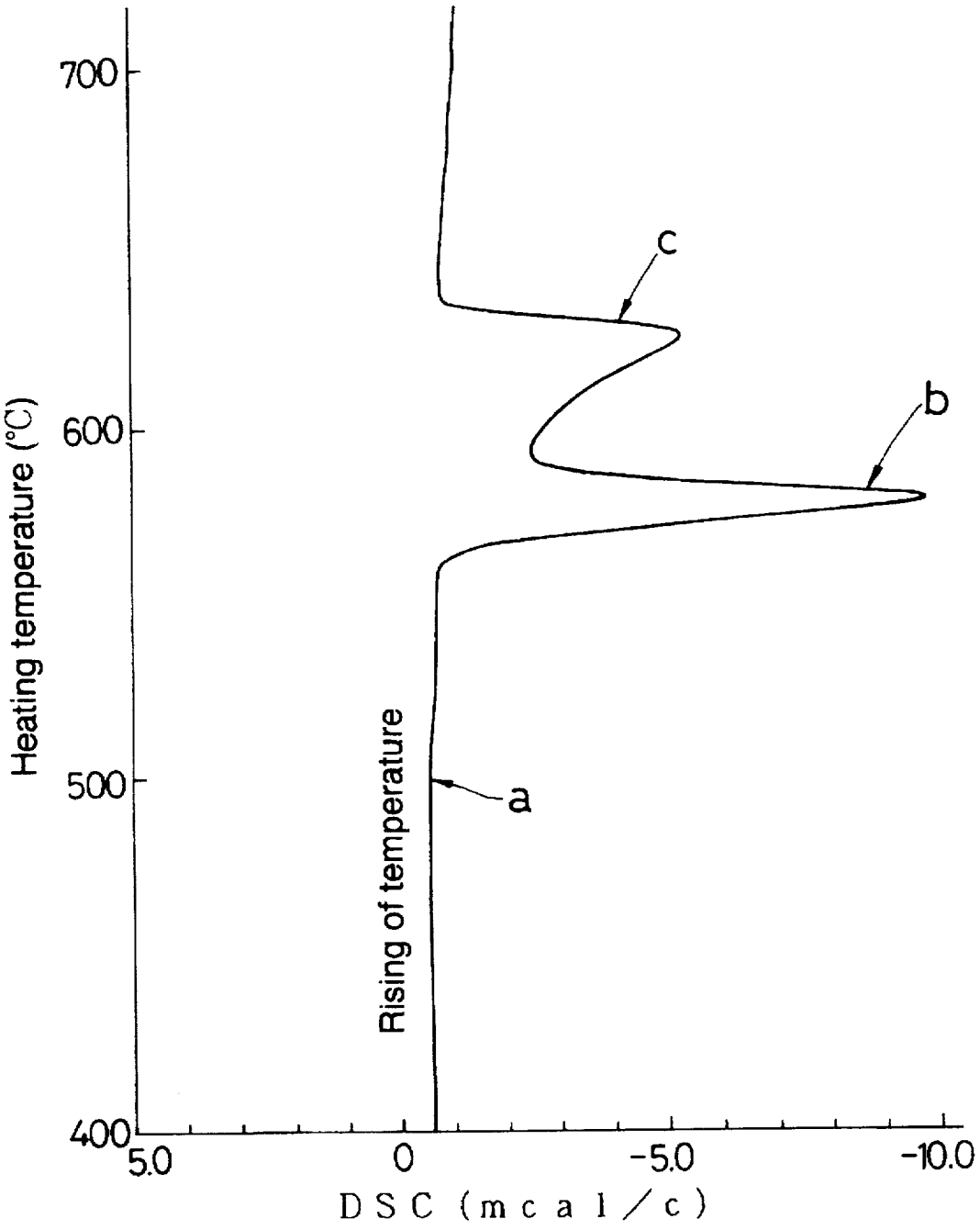
FIG. 32 shows a tenth example of a differential calorimetric curve.

The comparative example $a_1$ was also subjected to a differential scanning calorimetry (DSC) to provide a result shown in FIG. 32. In the differential calorimetric curve shown in FIG. 32, there are a first angled endothermic section b generated by the melting of a first component having a eutectic composition, and a second angled endothermic section c generated by the melting of a second component having a melting point higher than a eutectic point.

In the comparative example $a_1$, the first component is a eutectic crystal AlSi, and the second component is α-Al having a melting point of 629° C.

The difference in melting point between the crystals α-Al in the example $A_1$ and the comparative example $a_1$ is due to the fact that the solid solution elements in the crystals α-Al as well as the solution amounts are different from each other. The same is true of examples which will be described hereinafter.

Then, the example $A_1$ was placed into a heating coil in an induction heating apparatus and then heated under conditions of a frequency of 1 kHz and a maximum output of 30 kW to produce an example $A_1$ in a semi-molten state having solid and liquid phases coexisting therein. In this case, the solid phase content is set in a range of 40% (inclusive) to 60% (inclusive).

Thereafter, the example $A_1$ (designated by reference character 5) in the semi-molten state was placed into the chamber 6, as shown in FIG. 1, and charged through the gate 7 into the cavity 4 while being pressed under conditions of a temperature T of the example $A_1$ of 600° C., a molding speed of the pressing plunger 9 of 0.20 m/sec and a die temperature of 250° C. A pressing pressure was applied to the example $A_1$ filled in the cavity 4 by retaining the pressing plunger 9 at a stoke end, thereby solidifying the example $A_1$ under such applied pressure to provide an aluminum alloy cast product $A_1$.

In addition, an aluminum alloy cast product $a_1$ was produced by carrying out a casting operation under the same conditions as those described above, except that the comparative example $a_1$ was used and the temperature of the comparative example $a_1$ was set at 590° C.

Test pieces were fabricated from the aluminum alloy cast products $A_1$ and $a_1$, respectively, and subjected to a tension test at ambient temperature to provide results given in Table 7.

TABLE 7

| | Tension test at ambient temperature | | |
|---|---|---|---|
| Al alloy cast product | Tensile strength $\sigma_{0.2}$ (MPa) | Highest strength UTS (MPa) | Elongation σ (%) |
| $A_1$ | 297 | 356 | 10.1 |
| $a_1$ | 254 | 323 | 13.1 |

As is apparent from Table 7, the aluminum alloy cast product $A_1$ produced using the example $A_1$ has a higher strength than that of the aluminum alloy cast product $a_1$ produced using the comparative example $a_1$.

This is for the following reason: In the example $A_1$ having a thermal characteristic as shown in FIG. 31, when the second component (α-Al) is in a gelled state at the solidifying step of the thixocasting process, the liquid phase provided by the third component (the intermetallic compound) is started to be solidified, and when the third component is in a gelled state, the liquid phase provided by the first component (the eutectic crystal AlSi) is started to be solidified.

Figure 33A:
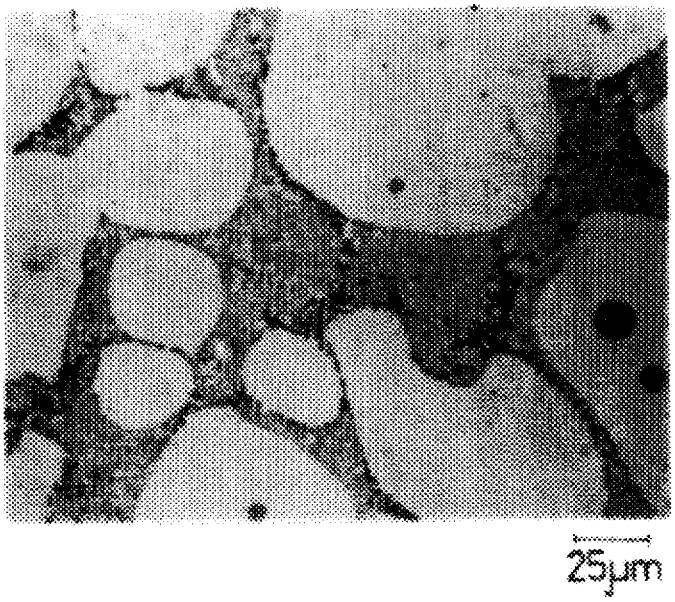
FIG. 33A is a photomicrograph showing a twelfth example of the metallographic structure of an aluminum alloy cast product.
Figure 33B:
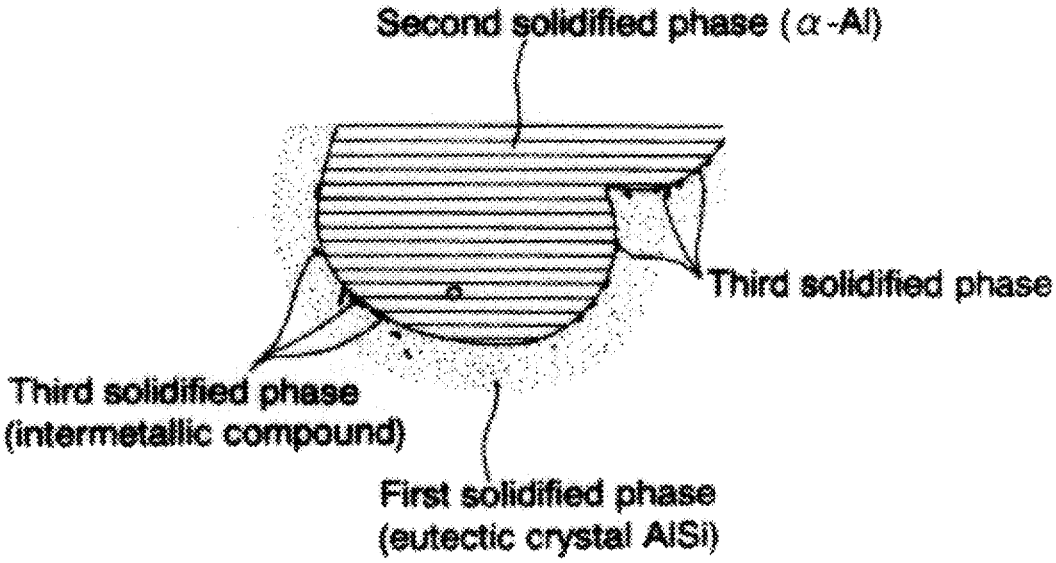
FIG. 33B is a diagram of the photomicrograph of an essential portion shown in FIG. 33A.

As a result, in the metallographic structure of the aluminum alloy cast product $A_1$ shown in FIGS. 33A and 33B, the bondability between a second solidified phase formed by the second component and a third solidified phase formed by the third component and dispersed in the grain boundaries in the second solidified phase is improved, and the bondability between a third solidified phase formed by the third component and a first solidified phase formed by the first component is also improved. Thus, the first and second solidified phases are firmly partially bonded to each other through the third solidified phase and therefore, an increase in strength of the aluminum alloy cast product $A_1$ is achieved. In order to ensure that first, second and third angled endothermic sections b, c and m appear as in the example $A_1$, it is desirable that the Fe content in the composition is set in a range of $Fe \geqq 0.2\%$ by weight, and the Mn content is set in a range of $Mn \geqq 0.1\%$ by weight.

Figure 34:
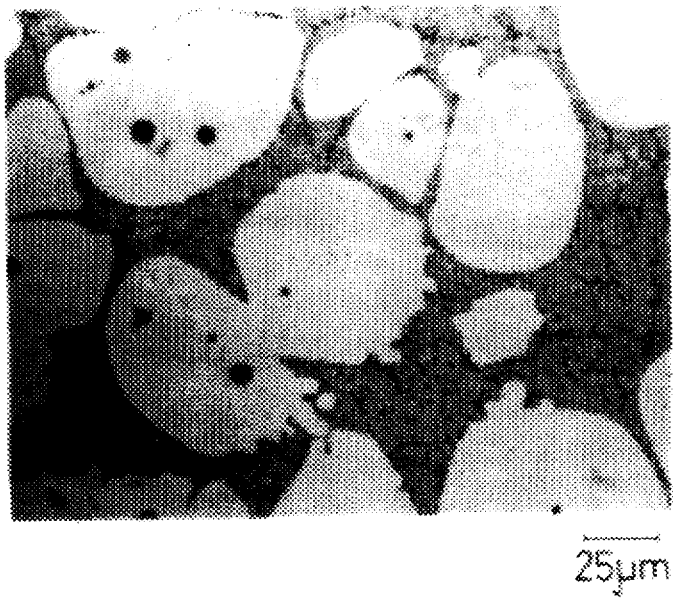
FIG. 34 is a photomicrograph showing a thirteenth example of the metallographic structure of an aluminum alloy cast product.

In the aluminum alloy cast product $a_1$, a third solidified phase does not exist, as shown in FIG. 34 and as a result, the strength of bonding between the first and second solidified phases is lower than that in the aluminum alloy cast product $A_1$.

When the first, second and third angled endothermic sections b, c and m exist in the differential calorimetric curve a, wherein the third angled endothermic section m appears due to the intermetallic compound, it is desirable that the temperature T (600° C.) of the semi-molten alloy material during casting is a temperature exceeding the temperature $T_3$ (591° C.) of the drop-end point f of the first angled endothermic section b, i.e., $T>T_3$, as described above. This is because the hard intermetallic compound is melted or started to be melted at the temperature $T>T_3$, resulting in a reduced strength and hence, the intermetallic compound is pulverized during passing through the gate 7, such that it can be finely dispersed in the cast product.

However, it is desirable that the temperature T of the semi-molten alloy material during casting is equal to or lower than the temperature $T_4$ (618° C.) of the peak g of the second angled endothermic section c, i.e., $T \leqq T_4$. This is for the following reason: When $T>T_4$, the shape retention of the semi-molten alloy material is deteriorated, resulting in a deteriorated transportability. In addition, the semi-molten alloy material cannot be charged sequentially in a laminar flow manner into the cavity 4 because of its low viscosity and as a result, blow holes are liable to be produced in the cast product. Further, the temperature control is difficult.

The relationship between the temperature T of the semi-molten alloy material during casting and the temperature $T_3$ of the drop-end point f as well as the temperature $T_4$ of the peak g, i.e., the relationship of $T_3<T \leqq T_4$ is the same as in the example $A_2$ which will be described below.

(2) Example 2

Table 8 shows the compositions of the example $A_2$ and the comparative example $a_2$ of the aluminum alloy material. The aluminum alloy material having such a composition is effective as a casting material for an aluminum alloy cast product which is used at a high temperature. Each of the example $A_2$ and the comparative example $a_2$ is a material cut away from a long continuous cast product of a high quality produced in a continuous casting process. In the production of the long continuous cast product, a spheroidizing of a primary crystal α-Al was performed. Each of the example $A_2$ and the comparative example $a_2$ has a diameter of 50 mm and a length of 65 mm.

TABLE 8

| Al alloy | Chemical constituent (% by weight) | | | | | | |
|---|---|---|---|---|---|---|---|
| material | Si | Cu | Fe | Mn | Mg | Ti | Balance |
| $A_2$ | 0.17 | 10.3 | 0.25 | 0.02 | 0.03 | 0.05 | Al |
| $a_2$ | 0.18 | 10.2 | 0.09 | 0.03 | 0.05 | 0.05 | Al |

Figure 35:
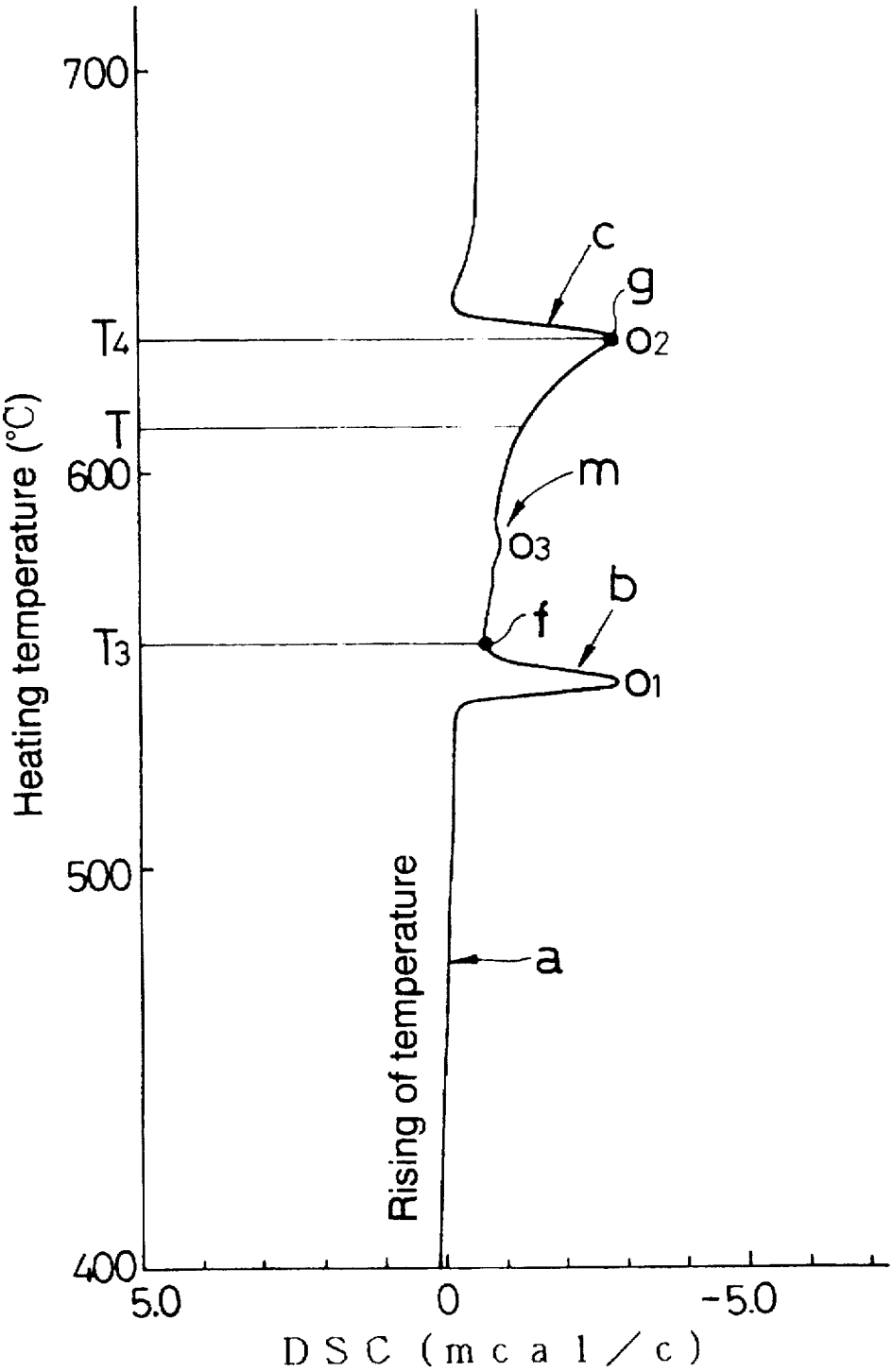
FIG. 35 shows an eleventh example of a differential calorimetric curve.

The example $A_2$ was subjected to a differential scanning calorimetry (DSC) to provide a result shown in FIG. 35. In the differential calorimetric curve a shown in FIG. 35, there are a first angled endothermic section b generated by the melting of a first component having a eutectic composition, a second angled endothermic section c generated by the melting of a second component having a melting point higher than a eutectic point, and a third angled endothermic section m existing between the first and second angled endothermic sections b and c due to the melting of a third component having a melting point higher than that of the first component and lower than that of the second component.

In this case, a relation, $o_1$ and $o_2>o_3$ (however, $o_1>o_2$), is established between peak values $o_1$, $o_2$ and $o_3$ of the first, second and third angled endothermic sections b, c and m. Thus, it is possible to suppress the amount of the intermetallic compound. When $o_3>o_1$ and $o_2$, the amount of the intermetallic compound is increased. This shows a behavior similar to the generation of defects in the cast product. Therefore, it is desirable that $o_1$, and $o_2 \geqq o_3$.

In the example $A_2$, the first component is a eutectic crystal Al—$Al_2Cu$ having a melting point of 545° C.; the second component is α-Al having a melting point of 636° C.; and the third component is an intermetallic compound ($Al_7FeCu_2$) having a melting point of 590° C.

Figure 36:
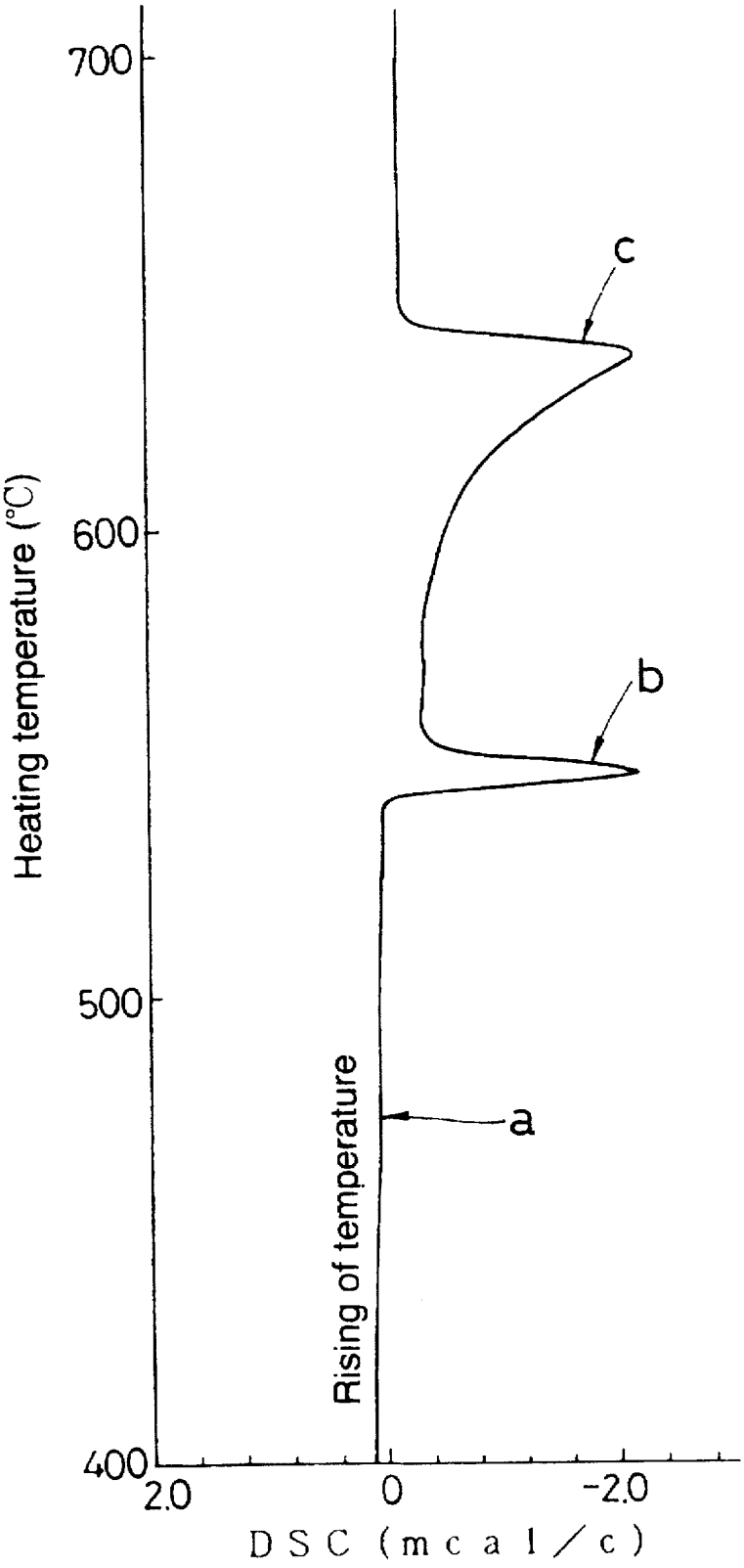
FIG. 36 shows a twelfth example of a differential calorimetric curve.

The comparative example $a_2$ was also subjected to a differential scanning calorimetry (DSC) to provide a result shown in FIG. 36. In the differential calorimetric curve a shown in FIG. 36, there are a first angled endothermic section b generated by the melting of a first component having a eutectic composition, and a second angled endothermic section c generated by the melting of a second component having a melting point higher than a eutectic point.

In the comparative example $a_2$, the first component is a eutectic crystal Al—$Al_2Cu$ having a melting point of 545° C., and the second component is α-Al having a melting point of 637° C.

Then, the example $A_2$ was placed into a heating coil in an induction heating apparatus and then heated under conditions of a frequency of 1 kHz and an maximum output of 30 kW to produce an example $A_2$ in a semi-molten state having solid and liquid phases coexisting therein. In this case, the solid content is set in a range of 40% (inclusive) to 60% (inclusive).

Thereafter, the example $A_2$ (designated by reference character 5) in the semi-molten state was placed into the chamber 6 and charged through the gate 7 into the cavity 4 while being pressed under conditions of a temperature T of the example $A_2$ of 610° C., a moving speed of the pressing plunger 9 of 0.20 m/sec and a die temperature of 250° C. Then, a pressing pressure was applied to the example $A_2$ filled in the cavity 4 by retaining the pressing plunger 9 at stroke end, thereby solidifying the example $A_2$ under such applied pressure to provide an aluminum alloy cast product $A_2$.

Using the comparative example $a_2$, an aluminum alloy cast product $a_2$ was also produced by carrying out a casting operation under the same conditions.

Then, test pieces were fabricated from the aluminum alloy cast products $A_2$ and $a_2$ and subjected to a tension test at a high temperature of 300° C. to provide results given in Table 9.

TABLE 9

| Al alloy cast product | Tension test at 300° C. Tensile strength $\sigma_{0.2}$ (MPa) | Highest strength UTS (MPa) | Elongation $\sigma$ (%) |
|---|---|---|---|
| $A_2$ | 115 | 149 | 14.2 |
| $a_2$ | 96 | 120 | 14.8 |

As is apparent from Table 9, the aluminum alloy cast product $A_2$ produced using the example $A_2$ has an excellent high-temperature strength, as compared with the aluminum alloy cast product $a_2$ produced using the comparative example $a_2$.

This is for the following reason: For the example $A_2$ having a thermal characteristic as shown in FIG. 35, the second component (α-Al) is in a gelled state at the solidifying step of the thixocasting process, the liquid phase formed by the third component (intermetallic compound) is started to be solidified, and when the third component is in a gelled state, the liquid phase formed by the first component (eutectic crystal Al—$Al_2Cu$) is started to be solidified.

Figure 37A:
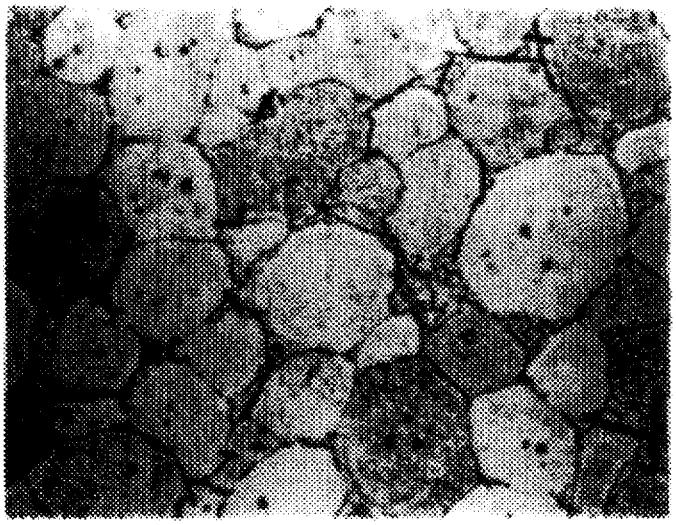
FIG. 37A is a photomicrograph showing a fourteenth example of the metallographic structure of an aluminum alloy cast product.
Figure 37B:
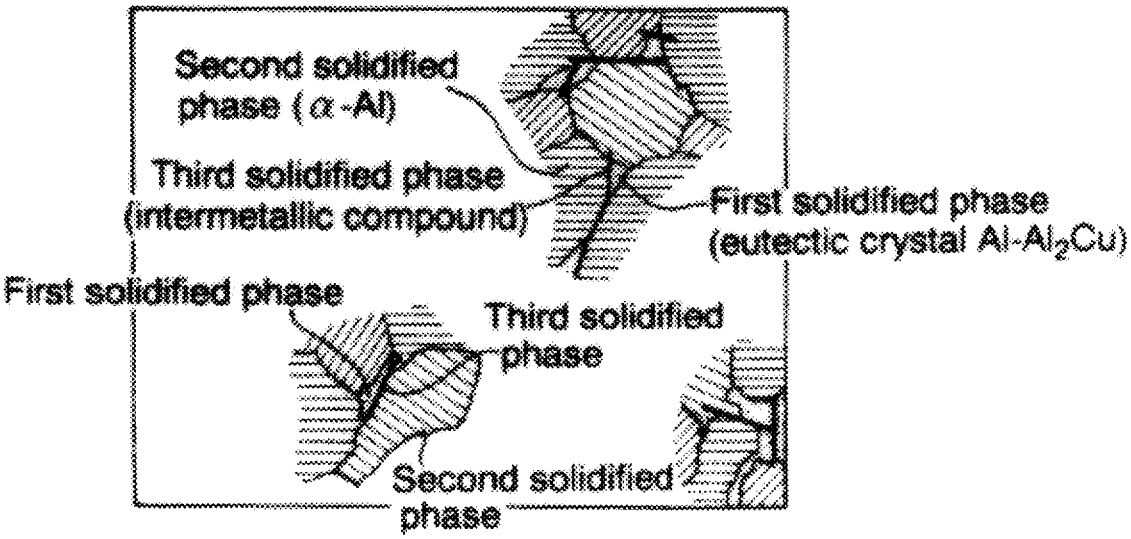
FIG. 37B is a diagram of the photomicrograph of an essential portion shown in FIG. 37A.

As a result, in a metallographic structure of the aluminum alloy cast product shown in FIGS. 37A and 37B, the bondability between the second solidified phase formed by the second component and the third solidified phase formed by the third component is improved, and the bondability between the third solidified phase formed by the third component and the first solidified phase formed by the first component is also improved. Thus, the first and second solidified phases is firmly partially bonded to each other through the third solidified phase and therefore, an increase in strength of the aluminum alloy cast product $A_2$ is achieved.

Figure 38:
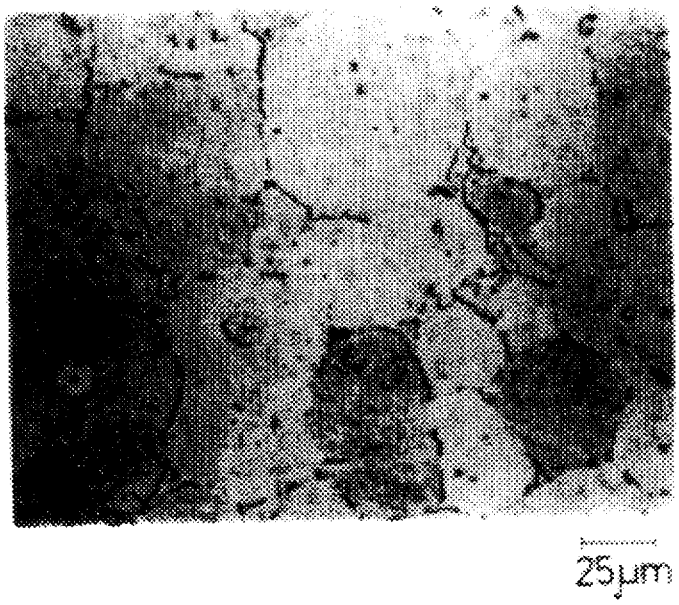
FIG. 38 is a photomicrograph showing a fifteenth example of the metallographic structure of an aluminum alloy cast product.

For the aluminum alloy cast product $a_2$, the third solidified phase does not exist as shown in FIG. 38 and as a result, the strength of bonding between the first and second solidified phases is lower than that in the aluminum alloy cast product $A_2$.

The alloy material in the third embodiment is not limited to the aluminum alloy material.

(Fourth Embodiment)

A thixocasting Al—Cu—Si based alloy material has a composition which will be described below.

The Al—Cu—Si based alloy material contains copper (Cu) with a content in a range of 8% by weight ≦Cu≦12% by weight; silicon (Si) with a content in a range of 0.01% by weight ≦Si≦1.5% by weight; iron (Fe) with a content in a range of Fe≦0.2% by weight; magnesium (Mg) with a content in a range of Mg≦0.1% by weight; at least one of manganese (Mn) with a content of 0.02% by weight ≦Mn≦0.4% by weight, vanadium (V) with a content of 0.05% weight ≦V≦0.15% by weight, zirconium (Zr) with a content of 0.1% by weight ≦Zr ≦0.25% by weight and titanium (Ti) with a content of 0.02% by weight ≦Ti≦0.1% by weight; and the balance of aluminum (Al).

The reason why the content of Si in this composition is as described above.

If the Cu content is set as described above, an Al—Cu—Si based alloy material is produced which has a thermal characteristic that a differential calorimetric curve having distinct first and second angled endothermic sections appears. Thus, it is possible to reliably develop a liquid phase from a eutectic crystal in the heating treatment to produce a semi-molten Al—Cu—Si based alloy material having a good castability.

In addition, if the Cu content is set as described above, it is possible to solid-solubilize copper (Cu) in the maximum amount into the solid phase formed by the primary crystal α-Al, thereby exhibiting an age-precipitating effect to the maximum by copper in the aluminum alloy cast product to enhance the high-temperature strength of the aluminum alloy cast product and to achieve increases in ductility and toughness of the aluminum alloy cast product.

However, if the Cu content is smaller than 8% by weight, it fails to produce an Al—Cu—Si alloy material having a thermal characteristic that a marvelous two-angled type differential calorimetric curve can appears, resulting in a deteriorated castability. On the other hand, if Cu>12% by weight, a produced aluminum alloy cast product has an increased high-temperature strength, but exhibits a low toughness and further, has an increased weight due to an increase in density.

The upper limit value of the Fe content is set as described above, because Fe exerts a detrimental influence to the mechanical characteristics of the aluminum alloy cast product.

The upper limit value of the Mg content is set as described above, because an intermetallic compound having a low melting point is otherwise produced, resulting in a reduced high-temperature strength of an aluminum alloy cast product.

Each of Mn, V, Zr and Ti is solid-solubilized in a very small amount in the primary crystal α-Al to contribute to an enhancement in high-temperature strength of the aluminum alloy cast product, in addition to the fine division of the primary crystal α-Al. However, in a condition where Mn<0.2% by weight, V<0.05% by weight, Zr<0.1% by weight or Ti<0.02% by weight, the above-described effect cannot be obtained. On the other hand, in a condition where Mn>0.4% by weight, V>0.15% by weight, Zr>0.25% by weight or Ti>0.1% by weight, manganese (Mn) or the like reacts with aluminum (Al) to produce an intermetallic compound, resulting in reduced elongation and toughness of an aluminum alloy cast product.

Table 10 shows the compositions of the examples $A_1$, $A_2$ and $A_2$ and the comparative examples $a_1$, $a_2$, $a_3$, $a_4$ and $a_5$. Each of these examples $A_1$ and the like is a material cut away from a long continuous cast product of a high quality produced in a continuous casting process. In the production of the long continuous cast product, a spheroidizing of a primary crystal α-Al was performed. Each of these examples $A_1$ and the like has a diameter of 76 mm and a length of 85 mm.

TABLE 10

| Al alloy material | Chemical constituent (% by weight) Cu | Si | Fe | Mg | Ni | Zn | Mn | Ti | Balance |
|---|---|---|---|---|---|---|---|---|---|
| $A_1$ | 10.2 | 0.8 | 0.15 | 0.02 | 0.1 | 0.2 | 0.27 | 0.1 | Al |
| $A_2$ | 8 | 1.1 | 0.15 | 0.02 | 0.1 | 0.2 | 0.27 | 0.1 | Al |
| $A_3$ | 12 | 1.2 | 0.18 | 0.02 | 0.1 | 0.2 | 0.25 | 0.1 | Al |
| $a_1$ | 10.1 | — | 0.15 | 0.02 | 0.1 | 0.2 | 0.25 | 0.1 | Al |
| $a_2$ | 10 | 2 | 1.5 | 0.28 | 0.5 | 0.8 | 0.5 | 0.25 | Al |
| $a_3$ | 10 | 4 | 1.2 | 0.28 | 0.5 | 0.5 | 0.5 | 0.2 | Al |
| $a_4$ | 6.8 | 0.2 | 0.3 | 0.02 | 0.02 | 0.2 | 0.3 | 0.1 | Al |
| $a_5$ | 13 | 0.9 | 0.1 | 0.02 | 0.1 | 0.2 | 0.25 | 0.1 | Al |

In Table 10, the comparative example $a_2$ corresponds to an AA specification 222 alloy; the comparative example $a_3$ corresponds to an AA specification 238 alloy (prior art); and the comparative example $a_4$ corresponds to an AA specification 2219 alloy.

Figure 39:
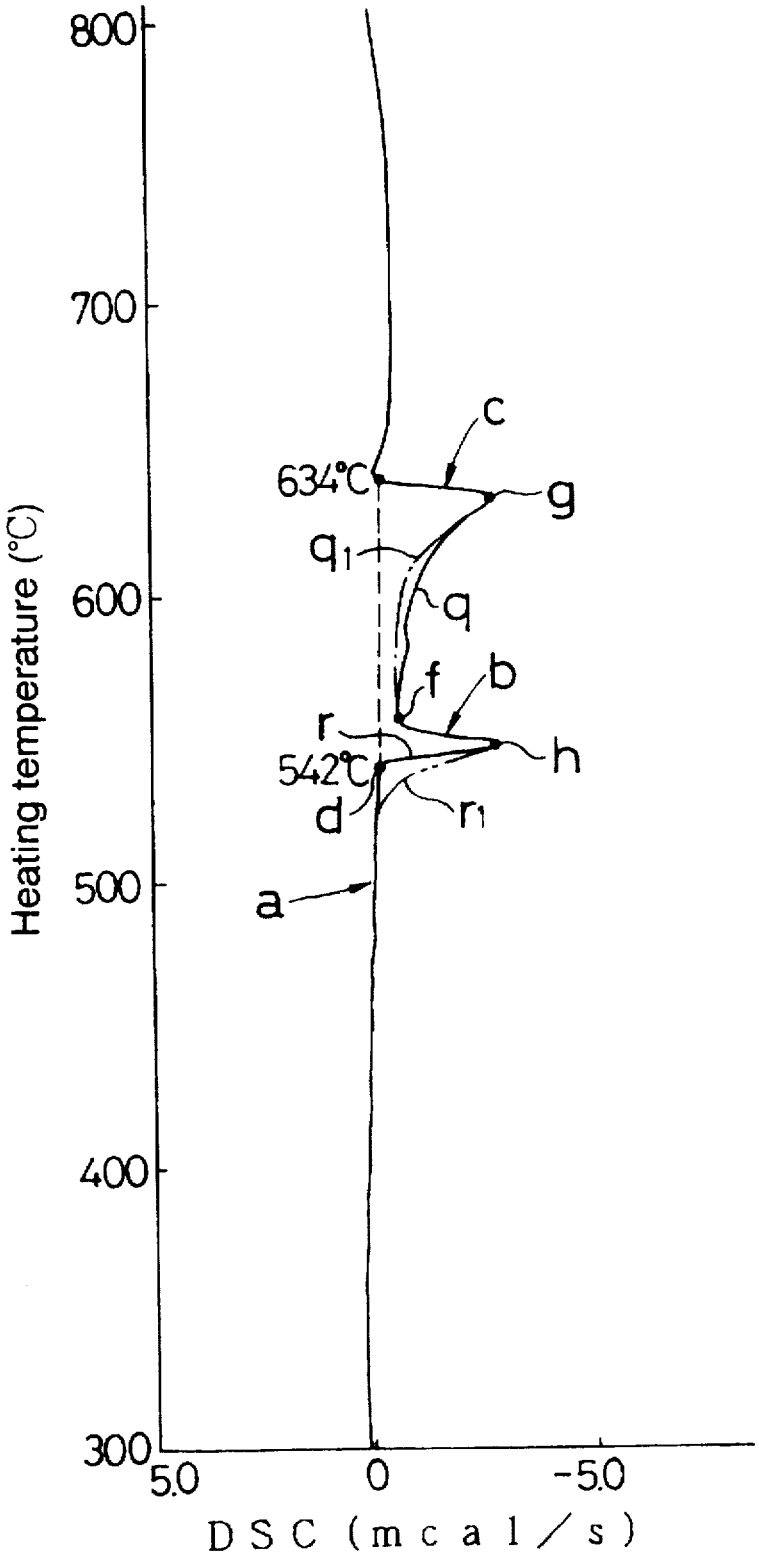
FIG. 39 shows a thirteenth example of a differential calorimetric curve.

The example $A_1$ was subjected to a differential scanning calorimetry to provide a result shown in FIG. 39. In a two-angled differential calorimetric curve a, a first angled endothermic section b appears due to the melting of a eutectic crystal $CuAl_2$, while a second angled endothermic section c appears due to the melting of a primary crystal α-Al.

Then, the example $A_1$ was placed into a heating coil in an induction heating apparatus and then heated under conditions of a frequency of 1 kHz and a maximum output of 37 kW to produce an example $A_2$in a semi-molten state having solid and liquid phases coexisting therein. In this case, the solid phase content is set in a range of 50% (inclusive) to 60% ( inclusive). For the example $A_1$, the differential calorimetric curve a having the distinct first and second angled endothermic sections b and c as shown in FIG. 39 appears, because the Cu content is of 10.2% by weight and hence, fallen in the range of 8% by weight $\leqq Cu \leqq 12\%$ by weight. Thus, it is possible to reliably develop the liquid phase from the eutectic crystal $CuAl_2$ in the heating treatment to produce the example $A_1$ in the semi-molten state, which has a good castability.

Thereafter, the example $A_1$ in the semi-molten state (designated by reference character 5) was placed into the chamber 6, as shown in FIG. 1 and charged through the gate 7 into the cavity 4 while being pressed under conditions of a moving speed of the pressing plunger 9 of 0.07 m/sec and a die temperature of 350° C. Then, a pressing pressure is applied to the example $A_1$ filled in the cavity by retaining the pressing plunger 9 at a stroke end, thereby solidifying the example $A_1$ under the applied pressure to provide an aluminum alloy cast product $A_1$.

Figure 40:
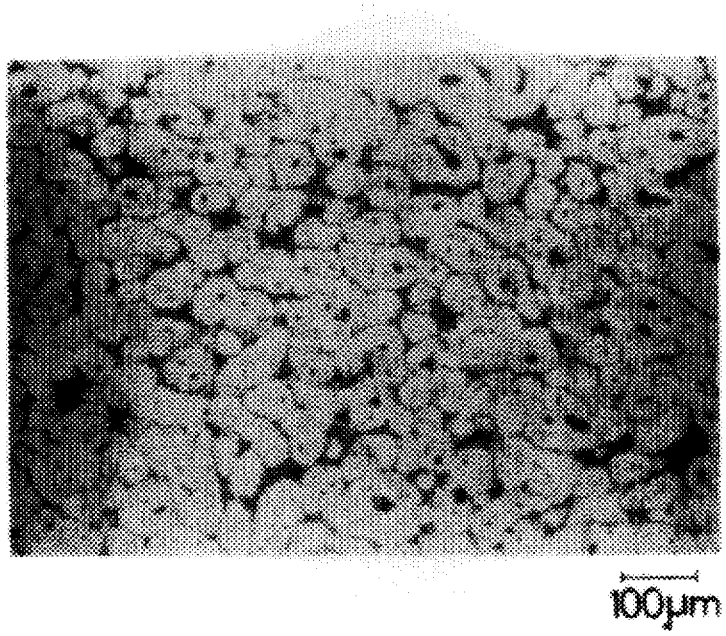
FIG. 40 is a photomicrograph showing a sixteenth example of the metallographic structure of an aluminum alloy cast product.

FIG. 40 is a photomicrograph showing the metallographic structure of the aluminum alloy cast product $A_1$. It can be seen from FIG. 40 that there are no defects of micron order generated in the aluminum alloy cast product $A_1$.

The reason why such sound aluminum alloy cast product $A_1$ is produced is as follows. Because the Si content is of 0.8% by weight and hence, is fallen in the range of 0.01% by weight $\leqq Si \leqq 1.5\%$ by weight, the inclination of arising line segment q of a second angled endothermic section b located a drop-end point f of a first angled endothermic section b and a peak g of the second angled endothermic section c is gentle and hence, the gelled state of the solid phase is maintained for a relatively long time. This provides a good bondability between the solid phases as well as between the solid and liquid phases.

On the other hand, in the first angled endothermic section b, the inclination of a rising line segment r located between a rise-start point d and a peak h is steep and hence, the viscosity of a finally solidified portion of the liquid phase is maintained low. This causes the liquid phase to be sufficiently supplied to portions around the solid phase in response to the solidification and shrinkage of the solid phase and thus, the generation of voids of micron order is avoided.

Even for the examples $A_2$ and $A_3$, a differential calorimetric curve a similar to that for the example $A_1$ appeared, and sound aluminum alloy cast products $A_2$ and $A_3$ (corresponding to the example $A_2$ and $A_3$, respectively) similar to the above-described example $A_1$ were produced by a casting operation using the examples $A_2$ and $A_3$ under the same conditions as those described above.

For the comparative example $a_1$, the inclination of a rising line segment $q_1$ of a second angled endothermic section c is steep, as shown by a one-dot dashed line in FIG. 39, because the Si content is zero and hence, is smaller than 0.01% by weight. Therefore, the solid phase is maintained in the gelled state for a shortened time, resulting in a deteriorated bondability between the solid phases as well as between the solid and liquid phases.

Figure 41A:
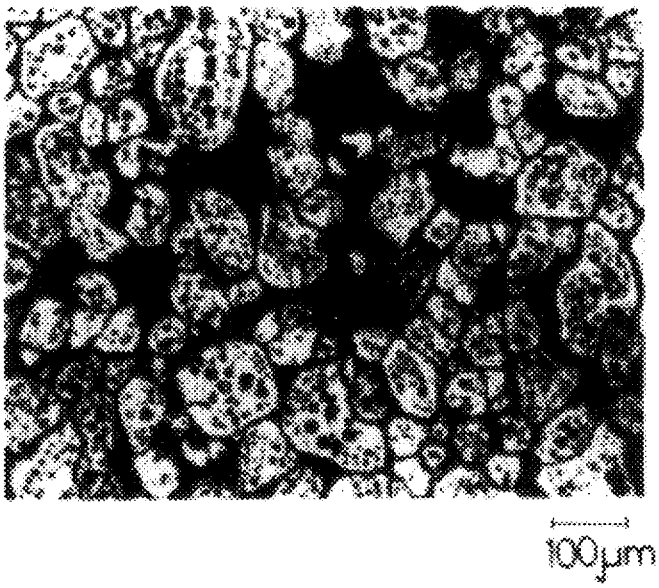
FIG. 41A is a photomicrograph showing a seventeenth example of the metallographic structure of an aluminum alloy cast product.
Figure 41B:
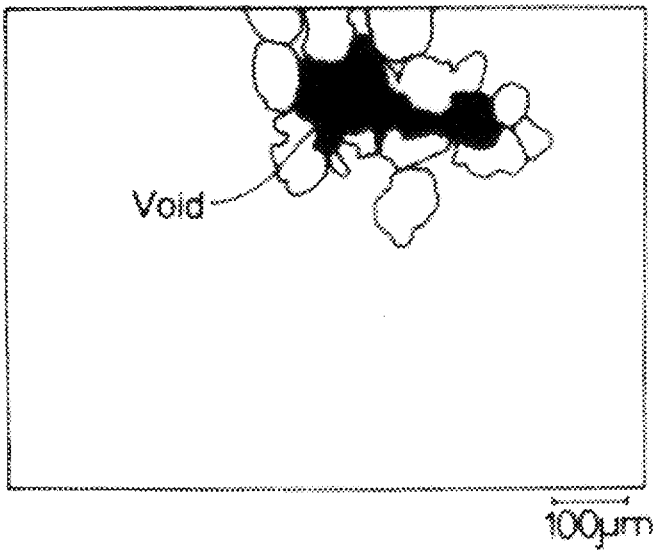
FIG. 41B is a diagram of the photomicrograph of an essential portion shown in FIG. 41A.

FIGS. 41A and 41B are a photomicrogragh and a diagram of that photomicrograph, respectively, showing the metallographic structure of an aluminum alloy cast product $a_1$ produced by a casting operation under the same conditions as those described above. It can be seen from FIGS. 41A and 41B that there are voids generated in the aluminum alloy cast product $a_1$.

On the other hand, for the comparative examples $a_2$ and $a_3$, the inclination of a rising line segment $r_1$ of a first angled endothermic section b is gentle as shown by a two-dot dashed line in FIG. 39, because the Si content is 2 and 4% by weight, respectively and hence, is larger than 1.5% by weight. Therefore, the viscosity of a finally solidified portion of the liquid phase is increased and hence, the liquid phase is not sufficiently supplied to portions around the solid phase in response to the solidification and shrinkage of the solid phase.

Figure 42A:
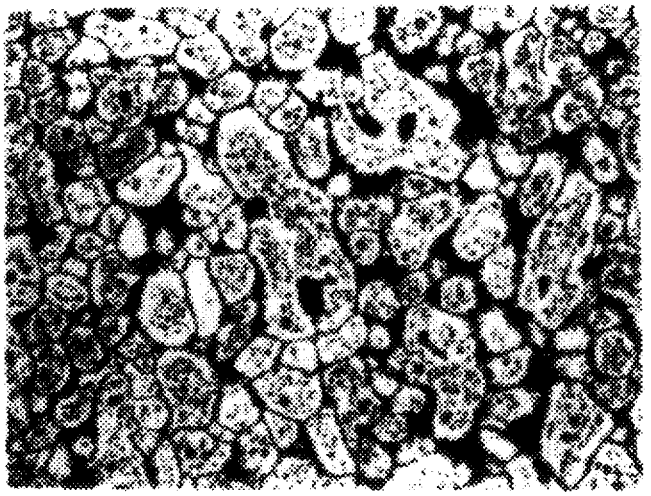
FIG. 42A is a photomicrograph showing an eighteenth example of the metallographic structure of an aluminum alloy cast product.
Figure 42B:
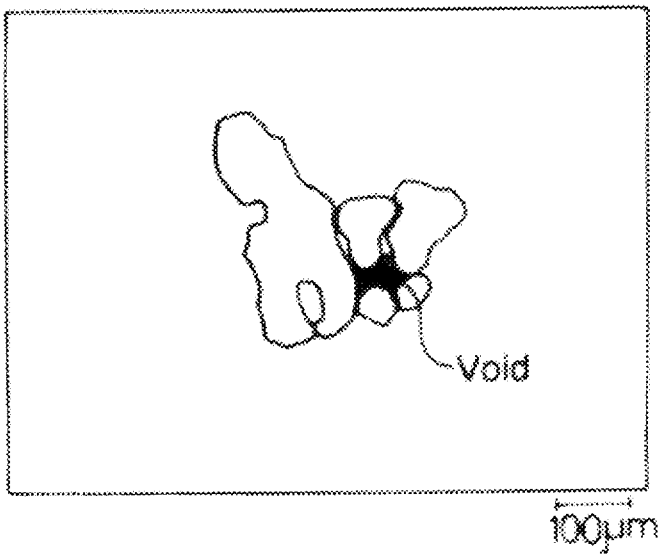
FIG. 42B is a diagram of the photomicrograph of an essential portion shown in FIG. 42A.

FIGS. 42A and 42B are a photomicrograph and a diagram of that photomicrograph, respectively showing the metallographic structure of an aluminum alloy cast product $a_3$ produced by a casting operation under the same conditions as those described above. It can be seen from FIGS. 42A and 42B that there are voids generated in the aluminum alloy cast product $a_3$.

For the comparative example $a_4$, a marvelous two-angled type differential calorimetric curve as shown in FIG. 39 does not appear, because the Cu content is of 6.8% by weight and hence, is smaller than 8% by weight. Therefore, the castability is deteriorated.

For the comparative example $a_5$, an aluminum alloy cast product $a_5$ produced therefrom has an increased high-temperature strength, because the Cu content is of 13% by weight, and hence, is larger than 12% by weight, but the aluminum alloy cast product $a_5$ exhibits a low toughness, and further, has an increased weight due to an increase in density.

Then, test pieces were fabricated from the aluminum alloy cast products $A_1$, $A_2$, $A_3$, $a_1$, $a_2$, $a_3$, $a_4$ and $a_5$ corresponding to the examples $A_1$, $A_2$ and $A_3$ and the comparative examples $a_1$, $a_2$, $a_3$, $a_4$ and $a_5$, and then measured for the tensile strength $\sigma_B$ and the elongation δ at 30° C. and also for the Charpy impact value and the density at ambient temperature, thereby providing the results given in Table 11.

TABLE 11

| Al alloy cast product | Tensile strength $\sigma_B$ (MPa) | Elongation σ (%) | Charpy impact value (J/cm$^2$) | Density (g/cm$^3$) |
|---|---|---|---|---|
| $A_1$ | 149 | 14.0 | 3.0 | 2.99 |
| $A_2$ | 120 | 15.5 | 3.8 | 2.96 |
| $A_3$ | 155 | 12.0 | 2.0 | 3.08 |
| $a_1$ | 103 | 10.0 | 1.5 | 2.99 |
| $a_2$ | 110 | 9.0 | 1.4 | 2.96 |
| $a_3$ | 102 | 8.0 | 1.2 | 2.97 |
| $a_4$ | 72 | 7.0 | 0.5 | 2.90 |
| $a_5$ | 150 | 11.2 | 1.4 | 3.12 |

It can be seen from Table 11 that each of the aluminum alloy cast products $A_1$, $A_2$ and $A_3$ produced using the examples $A_1$, $A_2$ and $A_3$has excellent high-temperature strength and ductility, a high toughness and a light weight.

Each of the aluminum alloy cast products $a_1$, $a_2$ and $a_3$ produced using the comparative examples $a_1$, $a_2$ and $a_3$ has lower high-temperature strength, ductility and toughness due to the generation of voids, as compared with those of the aluminum alloy cast products $A_1$, $A_2$ and $A_3$.

The aluminum alloy cast product $a_4$ produced using the comparative example $a_4$ has lowest mechanical properties due to the deteriorated castability.

The aluminum alloy cast product $a_5$ produced using the comparative example $a_5$ has an increased high-temperature strength because of the higher Cu content, but has a lower toughness and the largest weight.

What is claimed is:

1. A thixocasting process comprising the steps of:

subjecting to a heating treatment, an alloy material having a differential calorimetric curve in which a first angled endothermic section generated by the melting of a eutectic crystal and a second angled endothermic section generated by the melting of a component having a melting point higher than a eutectic point exist, thereby producing a semi-molten alloy material having a solid phase and a liquid phase coexisting therein, and pressing said semi-molten alloy material to conduct a charging of said semi-molten alloy material into a cavity in a casting mold and a subsequent solidification of said semi-molten alloy material under pressure, wherein said pressing step for said semi-molten alloy material is divided into a primary pressing stage and a secondary pressing stage which is subsequent to the primary pressing stage and at which a pressure larger than that at the primary pressing stage is applied, a start point of said primary pressing stage being established at a point when a temperature T of said semi-molten alloy material is in a range of $T_1<T\leqq T_4$ wherein $T_1$ is a temperature of a rise-start point in said first angled endothermic section and $T_4$ is a temperature of a peak in said second angled endothermic section the charging of said semi-molten alloy material into the cavity in the casting mold being completed at said primary pressing stage, and a start point of said secondary pressing stage being established at a point when the temperature T of said semi-molten alloy material is in a range of $T_1<T\leqq T_3$ wherein $T_3$ is a temperature of a drop-end point in said first angled endothermic section, said semi-molten alloy material being solidified at said secondary pressing stage, and wherein $T_1<T_3<T_4$.

2. A thixocasting process according to claim 1, wherein the start point of said secondary pressing stage is established at a point when the temperature T of said semi-molten alloy material is in a range of $T_1<T\leqq T_5$ wherein $T_5$ is a temperature of a peak of said first angled endothermic section, and wherein $T_1<T_5<T_3<T_4$.

3. A thixocasting process comprising the steps of:

preparing an alloy material having a differential calorimetric curve in which a first angled endothermic section generated by the melting of a eutectic crystal and a second angled endothermic section generated by the melting of a component having a melting point higher than a eutectic point exist, and said alloy material having a ratio $S_2/S_1$ of an area $S_2$ to an area $S_1$ in a range of $0.09\leqq S_2/S_1\leqq 0.57$, said area $S_1$ being an area of a two-angled planar region surrounded by said first and second angled endothermic section and a temperature graduation of a drop-end point on a heating temperature axis;

subjecting said alloy material to a heating treatment to produce a semi-molten alloy material; and pressing and charging the semi-molten alloy material into a cavity in a casting mold, wherein a casting temperature T of the semi-molten alloy material is set in a range of $T_3\leqq T\leqq T_4$, wherein $T_3$ is a temperature of the drop-end point of said first angled endothermic section, and $T_4$ is a temperature of a peak in said second angled endothermic section.

* * * * *

UNITED STATES PATENT AND TRADEMARK OFFICE

CERTIFICATE OF CORRECTION

PATENT NO. : 5,787,961
DATED : August 4, 1998
INVENTOR(S) : Nakamura et al.

It is certified that error appears in the above-identified patent and that said Letters Patent is hereby corrected as shown below:

Column 24,
Line 25, after "endothermic" insert -- sections and a base line connecting a rise-start point in said first angled endothermic section and a drop-end point in said second angled endothermic section, and said area $S_2$ being an area of a single-angled planar region in said first angled endothermic section which is provided when said area $S_1$ of said two-angled endothermic section ia bisected by a straight temperature line interconnecting a drop-end point in said first angled endothermic --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,787,961
DATED : August 4, 1998
INVENTOR(S) : Nakamura et al.

It is certified that error appears in the above-identified patent and that said Letters Patent is hereby corrected as shown below:

Column 24,
Line 25, after "endothermic" insert -- sections and a bsae line connecting a rise-start point in said first angled endothermic section and a drop-end point in said escond angled endothermic section, and said area $S_2$ being an area of a sinle-angled planar region in said first angled endothermic section which is provided when said area $S_1$ of said two-angled endothermic section is bisected by a straight temperature line interocnnecting a drop-end point in said first angled endothermic --.

This certificate supersedes Certificate of Correction issued Thirteenth day of October 2001.

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,787,961
APPLICATION NO. : 08/543196
DATED : August 4, 1998
INVENTOR(S) : Nakamura et al.

It is certified that error appears in the above-identified patent and that said Letters Patent is hereby corrected as shown below:

Column 24,
Line 25, after "endothermic" insert -- sections and a base line connecting a rise-start point in said first angled endothermic section and a drop-end point in said second angled endothermic section, and said area $S_2$ being an area of a sink-angled planar region in said first angled endothermic section which is provided when said area $S_1$ of said two-angled endothermic section is bisected by a straight temperature line interocnnecting a drop-end point in said first angled endothermic --.

This certificate supersedes Certificate of Correction issued October 30, 2001, and December 11, 2001.

Signed and Sealed this

Nineteenth Day of December, 2006

JON W. DUDAS
*Director of the United States Patent and Trademark Office*